US011412807B2

(12) United States Patent
Jwa

(10) Patent No.: US 11,412,807 B2
(45) Date of Patent: Aug. 16, 2022

(54) CHIN GUARD POSITIONING ASSEMBLY AND HELMET HAVING THE SAME

(71) Applicant: KIDO SPORTS CO., LTD., Seoul (KR)

(72) Inventor: Geun Ho Jwa, Seoul (KR)

(73) Assignee: KIDO SPORTS CO., LTD., Seoul (KR)

( * ) Notice: Subject to any disclaimer, the term of this patent is extended or adjusted under 35 U.S.C. 154(b) by 73 days.

(21) Appl. No.: 16/235,466

(22) Filed: Dec. 28, 2018

(65) Prior Publication Data

US 2020/0178639 A1 Jun. 11, 2020

(30) Foreign Application Priority Data

Dec. 5, 2018 (KR) ..... 10-2018-0155282

(51) Int. Cl.
*A42B 3/32* (2006.01)
*A42B 3/20* (2006.01)

(52) U.S. Cl.
CPC ..... *A42B 3/326* (2013.01); *A42B 3/205* (2013.01)

(58) Field of Classification Search
CPC ..... A42B 3/205; A42B 3/326; A42B 3/22; A42B 3/221; A42B 3/222; A42B 3/223
USPC ..... 2/417, 422, 424
See application file for complete search history.

(56) References Cited

U.S. PATENT DOCUMENTS 2,908,911 A * 10/1959 Sowle ..... A42B 3/20 2/9
3,216,023 A * 11/1965 Morgan ..... A42B 3/326 2/9
4,689,836 A * 9/1987 Vitaloni ..... A42B 3/326 2/411
4,769,857 A * 9/1988 Cianfanelli ..... A42B 3/326 2/424
4,794,652 A * 1/1989 Piech von Planta .. A42B 3/326 2/414
4,885,806 A * 12/1989 Heller ..... A42B 3/20 2/423

(Continued)

FOREIGN PATENT DOCUMENTS

EP 3430929 A1 1/2019
WO 2017159905 A1 9/2017

OTHER PUBLICATIONS

European Search Report dated Jul. 23, 2019 in European Application No. 18248070.7.

*Primary Examiner* — Jocelyn Bravo
(74) *Attorney, Agent, or Firm* — Panitch Schwarze Belisario & Nadel LLP

(57) ABSTRACT

A chin guard positioning assembly connects a helmet body and a chin guard to each other. The helmet body provides a certain space to allow a user's head to be inserted thereinto and the position of the chin guard is allowed to be moved from a protective position to an open position. The chin guard positioning assembly includes a movable base part in which a position thereof is moved together with the chin guard. A fixed base part is connected to the helmet body and connected to the movable base part to serve as a reference for the movement of the position of the movable base part. A fixed magnetic force part is fixed to the fixed base part. A movable magnetic force part is fixed to the movable base part to fix the movable base part to a first position or a second position.

18 Claims, 35 Drawing Sheets

(56) References Cited

U.S. PATENT DOCUMENTS 6,834,398 B1 * 12/2004 Martinez ..... A42B 3/326 2/424
7,555,788 B2 * 7/2009 Schimpf ..... A42B 3/326 2/410
7,934,497 B1 * 5/2011 Grove ..... A42B 3/288 128/201.25
8,051,500 B2 * 11/2011 Lee ..... A42B 3/222 2/424
8,056,152 B2 * 11/2011 Brace ..... A42B 3/225 2/424
8,082,600 B2 * 12/2011 Morin ..... A42B 3/326 2/424
8,296,868 B2 * 10/2012 Belanger ..... A42B 3/324 2/420
9,788,593 B2 * 10/2017 Lebel ..... A42B 3/326
10,371,487 B2 * 8/2019 Hall ..... A42B 3/04
10,492,556 B1 * 12/2019 Lee ..... H04R 1/026
10,492,559 B1 * 12/2019 Kele ..... A42B 3/326
2002/0104533 A1 * 8/2002 Kalhok ..... A42B 3/24 128/201.24
2002/0129440 A1 * 9/2002 Hong ..... A42B 3/326 2/422
2003/0182716 A1 * 10/2003 Wu ..... A42B 3/326 2/424
2003/0209241 A1 * 11/2003 Fournier ..... A42B 3/288 128/201.22
2003/0217408 A1 * 11/2003 Fournier ..... A42B 3/326 2/424
2005/0015861 A1 * 1/2005 Gafforio ..... A42B 3/326 2/424
2006/0064799 A1 * 3/2006 Dion ..... A42B 3/222 2/424
2007/0124851 A1 * 6/2007 Pyo ..... A42B 3/326 2/424
2008/0196148 A1 * 8/2008 Morin ..... A42B 3/326 2/421
2008/0216215 A1 * 9/2008 Lee ..... A42B 3/326 2/424
2009/0183302 A1 * 7/2009 Choi ..... A42B 3/222 2/424
2010/0064406 A1 * 3/2010 Lee ..... A42B 3/226 2/10
2011/0023204 A1 * 2/2011 Brace ..... A42B 3/225 2/8.2
2011/0072564 A1 * 3/2011 Krauter ..... A42B 3/185 2/422
2011/0154551 A1 * 6/2011 Spink ..... A42B 3/223 2/10
2011/0302701 A1 * 12/2011 Kuo ..... A42B 3/326 2/421
2012/0137413 A1 * 6/2012 DeBoer ..... A42B 3/18 2/424
2012/0284905 A1 * 11/2012 Kim ..... A42B 3/227 2/424
2013/0283508 A1 * 10/2013 Durham ..... A42B 3/221 2/422
2014/0033406 A1 * 2/2014 Lebel ..... A42B 3/326 2/422
2014/0075654 A1 * 3/2014 McGinn ..... A42B 3/18 2/422
2014/0173811 A1 * 6/2014 Finiel ..... A42B 3/04 2/422
2016/0015114 A1 * 1/2016 Berthier ..... A42B 3/222 2/424
2017/0164679 A1 * 6/2017 Schmitter ..... A42B 3/326
2017/0188646 A1 * 7/2017 Liang ..... G02B 27/0176
2017/0196294 A1 * 7/2017 Fischer ..... A42B 3/328
2017/0215510 A1 * 8/2017 Demers ..... A42B 3/0446
2019/0014852 A1 * 1/2019 An ..... A42B 3/221
2019/0387825 A1 * 12/2019 Lee ..... F16B 47/00
2020/0029645 A1 * 1/2020 Salvetti ..... A42B 3/222
2020/0029646 A1 * 1/2020 Salvetti ..... A42B 3/222

* cited by examiner

CHIN GUARD POSITIONING ASSEMBLY AND HELMET HAVING THE SAME

CROSS-REFERENCE TO RELATED APPLICATION

This application claims priority to and the benefit of Korean Patent Application No. 10-2018-0155282, filed on Dec. 5, 2018, the disclosure of which is incorporated herein by reference in its entirety.

BACKGROUND

1. Field of the Invention

The present disclosure relates to a chin guard positioning assembly and a helmet having the same, and more particularly, to a chin guard positioning assembly capable of determining the position of a chin guard configured to protect a user's chin and a helmet having the same.

2. Discussion of Related Art

Motorcycle helmets are used to protect a head and face of a user riding a motorcycle. The motorcycle helmets are released in various types to allow several factors such as purpose, application purpose, and user's preference to be taken into consideration. When each type of the helmets is simply listed to describe specifically, full-face helmets are the most basic helmets that are formed to surround a head and entire face of a rider. Half-face helmets are easily worn helmets that are formed to surround only a top of the rider's head. Open-face helmets are the intermediate form of the full-face helmets and the half-face helmets which are formed to surround the head and a portion of the face so that a chin portion is exposed. System helmets are the same as the full-face helmets in that the helmets surround the head and the entire face but differ in that the helmets can be opened and closed in the portion in which the chin is surrounded.

Due to the recent tendency to pursue both safety and convenience, the demand for system helmets is increasing, and thus, various products are being released. Each product has a different mechanism to move the position of a chin guard, and thus they have differentiation from each other. A chin guard opening and closing device (Korean Patent Registration No. 10-0659171, registered on Dec. 12, 2006) of a conventional system helmet, which is one product among those, is a device implemented using a mechanism utilizing a rack-pinion and has problems in that it is difficult to manufacture and failure rate is high when it is used for a long time. Further, since the chin guard moves only when an external force is applied, the conventional chin guard caused problems that the chin guard may not be effectively operated in a situation in which the external force cannot be effectively transmitted thereto, for example, when a driver wears a thick coat.

SUMMARY OF THE INVENTION

The present disclosure is directed to a chin guard positioning assembly having a simple structure and high durability, and a helmet having the same.

However, the problems to be solved by the present disclosure are not limited to the above-described problems, and problems that are not mentioned above should be understood by a person of ordinary skill in the art to which the disclosure pertains from this disclosure and the accompanying drawings.

According to an aspect of the present disclosure, there is provided a chin guard positioning assembly which connects a helmet body and a chin guard to each other, wherein the helmet body provides a certain space to allow a user's head to be inserted thereinto and a position of the chin guard is moved from a protective position, which is a position where a user's chin is protected, to an open position, which is a position where the user's chin is not protected or moved from the open position to the protective position, and the chin guard positioning assembly includes a movable base part which provides a certain region to allow the chin guard to be connected thereto and in which a position thereof is moved together with the chin guard when the position of the chin guard is moved, a fixed base part connected to the helmet body and connected to the movable base part to serve as a reference for the movement of the position of the movable base part, a fixed magnetic force part fixed to the fixed base part, and a movable magnetic force part fixed to the movable base part to fix the movable base part to a first position or a second position by interacting with a magnetic force of the fixed magnetic force part.

The first position may be a position closer to a position of the movable base part when the chin guard is in the protective position than a position of the movable base part when the chin guard is in the open position, and the second position may be a position closer to the position of the movable base part when the chin guard is in the open position than the position of the movable base part when the chin guard is in the protective position.

The movable magnetic force part may include a first movable magnetic force part which interacts with the magnetic force of the fixed magnetic force part when the movable base part is in the first position, and a second movable magnetic force part which is spaced apart from the first movable magnetic force part so as to interact with the magnetic force of the fixed magnetic force part when the movable base part is in the second position.

The movable base part may include a movable body part which provides a certain region on which the chin guard is seated and to which the movable magnetic force part is fixed and provides a movement connection part which is connected to the movable body part and simultaneously connected to the fixed base part and moved only in a predetermined path on a fixed body part. The fixed base part may include the fixed body part formed with a guide part configured to provide the predetermined path and a rotating shaft part which is rotated on the fixed base part so that the movable body part is connected to the rotating shaft part to allow the movable body part to be rotated. The movable body part may be slid on the rotating shaft part corresponding to the movement of the position of the movement connection part to allow a separation distance between the rotating shaft part and the movement connection part to be changed when the position of the movable base part is moved from the first position to the second position or from the second position to the first position.

At least a portion of a side surface of the rotating shaft part may be formed to be flat to allow the movable body part to be slid thereon.

The guide part may be formed to pass through from one surface to the other surface of the fixed body part so that a radius of curvature thereof is variably extended in one direction, and the movement connection part may be inserted into the guide part.

The movable body part may be formed with a lead part into which the rotating shaft part is inserted and through which the rotating shaft part is slid when the position of the movable body part is moved, and the first movable magnetic force part may be disposed to face the second movable magnetic force part with respect to the lead part The chin guard positioning assembly further includes a shield moving part which is connected to a shield part configured to protect the user's face to implement the movement of the position of the shield part, wherein the position of the shield moving part may be moved to allow the shield part to protect the user's face when the shield moving part is in a front position or allow the shield part to not protect the user's face when the shield moving part is in a rear position. The fixed base part may include a rotating shaft part which is rotatably connected thereto so that a fixed body part and a movable body part are connected to the rotating shaft part to allow the movable body part to be rotated, and when the movable base part is brought into contact with the rotating shaft part and the position of the movable base part is moved from the second position to the first position, the position of the shield moving part may be moved from the front position to the rear position according to the rotation of the rotating shaft part.

The rotating shaft part may include a shaft part rotated on the fixed body part when the movable body part is connected, and a position thereof is moved and a protrusion formed to protrude from the shaft part in one direction, and when the movable base part is brought into contact with the protrusion and the position of the movable base part is moved from the second position to the first position, the position of the shield moving part may be moved from the front position to the rear position according to the rotation of the protrusion.

The shield moving part may include a shield connection part connected to the shield part, a movement contact part which is brought into contact with the protrusion, and a movement extension part configured to connect the shield connection part and the movement contact part to each other, the shield connection part may be formed to extend from one side surface of one end portion of the movement extension part in one direction, and the movement contact part may be formed to extend from one side surface of the other end portion of the movement extension part in one direction.

According to another aspect of the present disclosure, there is provided a chin guard positioning assembly which connects a helmet body and a chin guard to each other, wherein the helmet body provides a certain space to allow a user's head to be inserted thereinto and a position of the chin guard is moved from a protective position, which is a position where a user's chin is protected, to an open position, which is a position where the user's chin is not protected, or moved from the open position to the protective position, and the chin guard positioning assembly includes a movable base part which provides a certain region to allow the chin guard to be seated thereon so that the chin guard is connected thereto, a fixed body part which is connected to the helmet body and provides a certain region to allow the movable base part to be seated thereon, a rotating shaft part which is rotatably connected to a fixed base part so that the movable base part is connected thereto to allow a movable body part to be rotated, a fixed magnetic force part fixed to the fixed base part, and a movable magnetic force part which is fixed to the movable base part and interacts with a magnetic force of the fixed magnetic force part to allow the movable base part to be fixed to a first position or a second position while the movable base part is rotated by the rotating shaft part.

The movable magnetic force part may include a first movable magnetic force part and a second movable magnetic force part disposed to be spaced apart from the first movable magnetic force part.

The movable base part may include: the movable body part which provides a certain region on which the chin guard is seated and to which the movable magnetic force part is fixed and the rotating shaft part is connected and provides a movement connection part formed to protrude from the movable body part in a direction opposite to a direction in which the chin guard is disposed, a guide part may be formed in the fixed body part to pass through from one surface to the other surface of the fixed body part so that the movement connection part is inserted thereinto, and a lead part may be formed in the movable body part to pass through from one surface to the other surface of the movable body part so that the rotating shaft part is inserted thereinto.

The guide part may be formed to pass through from one surface to the other surface of the fixed body part to be extended in one direction with a variable radius of curvature thereof.

The lead part may be formed to extend in one direction to allow the rotating shaft part to be slid when the position of the movable body part is moved.

The movable magnetic force part may include a first movable magnetic force part and a second movable magnetic force part disposed to face the first movable magnetic force part with respect to the lead part.

The chin guard positioning assembly further includes a shield moving part connected to a shield part configured to protect a user's face to implement the movement of a position of the shield part and the shield moving part being is seated on the fixed body part in a direction opposite to a direction in which the movable base part is seated on the fixed body part, wherein the shield moving part may include a shield connection part disposed on an upper end portion of the fixed body part and connected to an end portion of the shield part and include a movement contact part disposed on a lower end portion of the fixed body part, and a movement extension part configured to connect the shield connection part and the movement contact part to each other, and the shield connection part may be formed to extend from one side surface of one end portion of the movement extension part in one direction, and the movement contact part may be formed to extend from one side surface of the other end portion of the movement extension part in one direction.

The rotating shaft part may include a shaft part connected to the movable body part and rotatably connected to the fixed body part and a protrusion formed to protrude from the shaft part in one direction, one end portion of the shaft part may be connected to the movable base part, and the protrusion may be formed to protrude from the other end portion of the shaft part.

A position of the shield moving part may be moved to allow the shield part to protect the user's face when the shield moving part is in a front position and to allow the shield part to not protect the user's face when the shield moving part is in a rear position, and when the shield moving part is in the front position, the movement extension part may be disposed at a position which is in conflict with a movement path of the protrusion while the movable base part is rotated.

According to still another aspect of the present disclosure, there is provided a helmet comprising: a helmet body configured to provide a certain space to allow a user's head to be inserted thereinto; a chin guard in which a position thereof is moved from a protective position, which is a position where a user's chin is protected, to an open position, which is a position where the user's chin is not protected, or moved from the open position to the protective position; and a chin guard positioning assembly configured to connect the helmet body and the chin guard to each other, wherein the chin guard positioning assembly includes a movable base part which provides a certain region to allow the chin guard to be connected thereto and in which a position thereof is moved together with the chin guard when the position of the chin guard is moved, a fixed base part connected to the helmet body and connected to the movable base part to serve as a reference for the movement of the position of the movable base part, a fixed magnetic force part fixed to the fixed base part, and a movable magnetic force part fixed to the movable base part to fix the movable base part to a first position or a second position by interacting with a magnetic force of the fixed magnetic force part.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
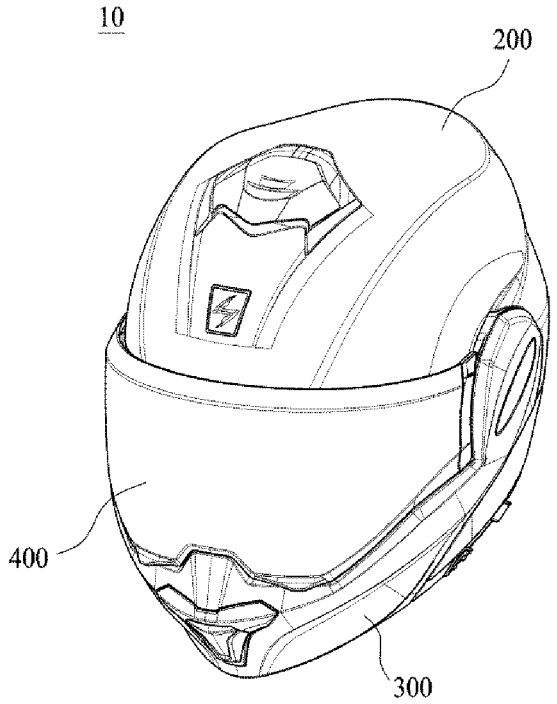
FIG. 1 is an overall perspective view of a helmet according to one embodiment of the present disclosure.

Hereinafter, exemplary embodiments of the present disclosure will be described in detail below with reference to the accompanying drawings. However, the spirit of the present disclosure is not limited to suggested embodiments, and one skilled in the art who understands the spirit of the present disclosure may easily suggest other embodiments included in other retrogressive embodiments or the scope of the spirit of the present disclosure by adding, modifying, or deleting other components within the scope of the same spirit. However, it will also be understood that this will be included in the scope of the present disclosure.

Also, like reference numerals are used for like elements having the same functions within the scope of the same spirit illustrated in the drawings of embodiments.

In the present specification, when it is determined that detailed descriptions of related well-known functions or configurations unnecessarily obscure the gist of the present disclosure, the detailed descriptions thereof will be omitted.

Figure 2:
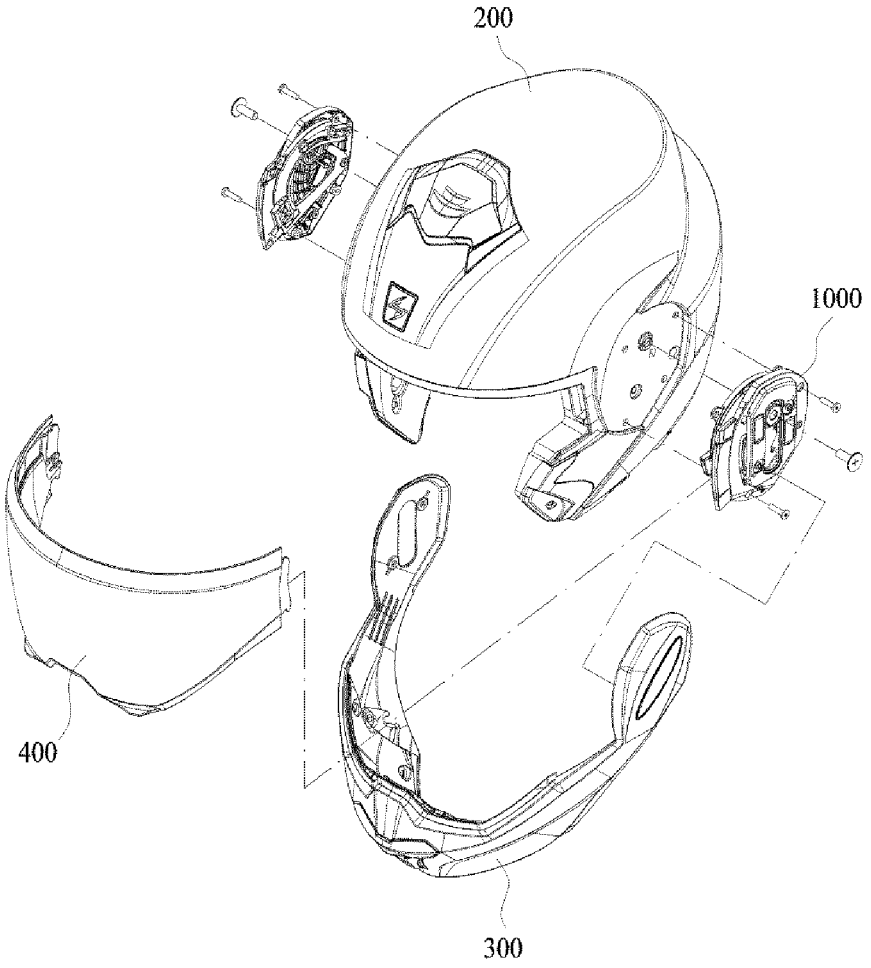
FIG. 2 is an exploded perspective view of the helmet according to one embodiment of the present disclosure.

FIG. 1 is an overall perspective view of a helmet according to one embodiment of the present disclosure, and FIG. 2 is an exploded perspective view of the helmet according to one embodiment of the present disclosure.

Referring to FIGS. 1 and 2, a helmet 10 according to one embodiment of the present disclosure may include a helmet body 200 configured to provide a certain space into which a user's head may be inserted, a chin guard 300 in which a position thereof may be moved to an open position, which is a position where a user's chin may not be protected, or moved from the open position to a protective position, and a chin guard positioning assembly 1000 configured to connect the helmet body 200 to the chin guard 300.

Further, the helmet 10 may further include a shield part 400 configured to protect a front surface of a user's face.

The helmet body 200 may provide a certain space in an inside direction thereof to surround the user's head and a portion of the user's face.

When the user's head is inserted into the space provided by the helmet body 200, side surfaces (for example, cheeks, ears, or the like) of the user's face may be protected by the helmet body 200, but the front surface (for example, eyes, a nose, and a mouth and a chin) of the user's face may not be protected by the helmet body 200.

The chin guard 300 may surround the user's chin to protect the user's chin.

One end portion of the chin guard 300 may be connected to one side surface of the helmet body 200 through the chin guard positioning assembly 1000.

Further, the other end portion of the chin guard 300 may be connected to the other side surface of the helmet body 200 through the chin guard positioning assembly 1000.

One portion of the chin guard positioning assembly 1000 may be coupled to the helmet body 200, and another portion of the chin guard positioning assembly 1000 may be coupled to the chin guard 300.

In other words, the chin guard positioning assembly 1000 may intervene between the helmet body 200 and the chin guard 300.

Further, the chin guard positioning assembly 1000 may determine the position of the chin guard 300 so that the chin guard 300 may be rotated with respect to the helmet body 200.

Hereinafter, the chin guard positioning assembly 1000 will be described in detail.

Figure 3:
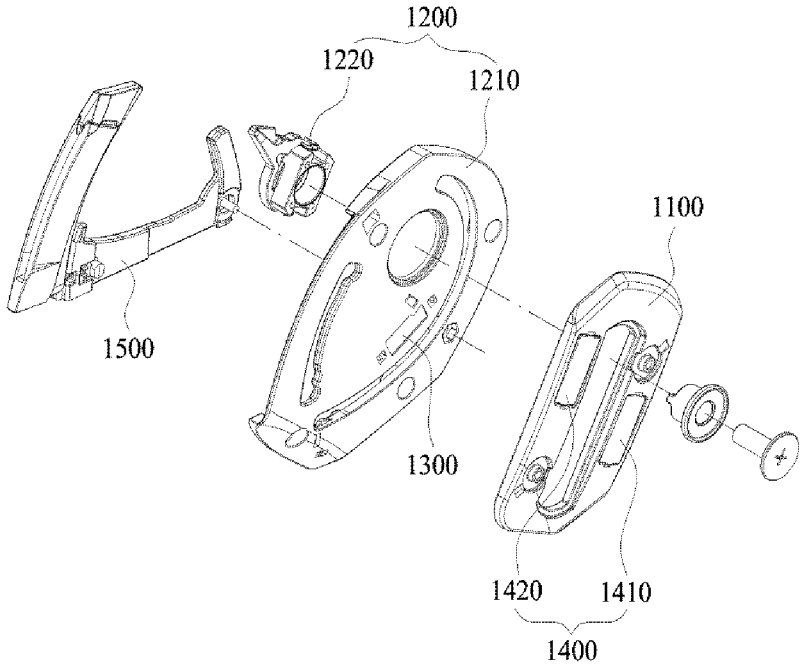
FIG. 3 is an exploded perspective view of a chin guard positioning assembly according to one embodiment of the present disclosure.

FIG. 3 is an exploded perspective view of a chin guard positioning assembly according to one embodiment of the present disclosure.

Referring to FIG. 3, the chin guard positioning assembly 1000 according to one embodiment of the present disclosure may include a movable base part 1100 which provides a certain region to which the chin guard 300 may be connected and in which a position thereof is moved together with the chin guard 300 when the chin guard 300 is moved, a fixed base part 1200 connected to the helmet body 200 and connected to the movable base part 1100 to serve as a reference for movement of the position of the movable base part 1100, a fixed magnetic force part 1300 fixed to the fixed base part 1200, and a movable magnetic force part 1400 which is fixed to the movable base part 1100 to fix the movable base part 1100 to a first position or a second position by interacting with a magnetic force of the fixed magnetic force part 1300.

Hereinafter, each component of the chin guard positioning assembly 1000 will be described in detail.

Figure 4A:
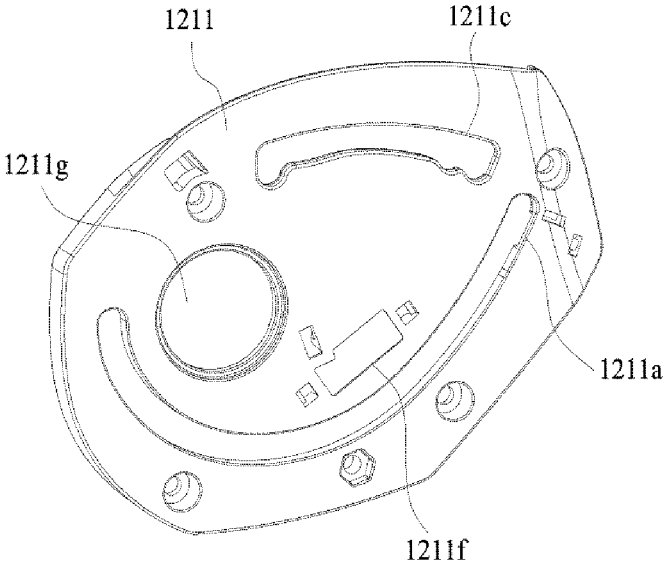
FIG. 4A is a front perspective view of the fixed body part provided in the chin guard positioning assembly according to one embodiment of the present disclosure.
Figure 4B:
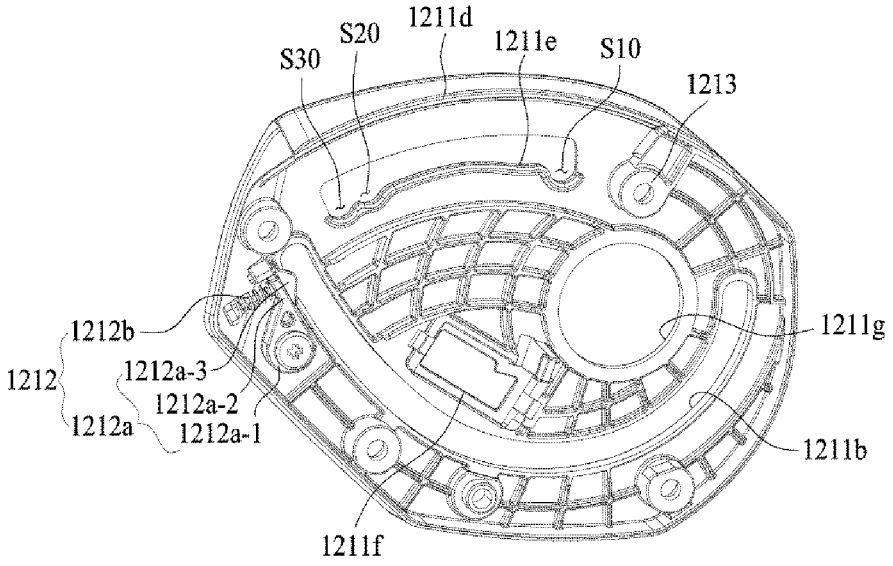
FIG. 4B is a rear perspective view of the fixed body part provided in the chin guard positioning assembly according to one embodiment of the present disclosure.
Figure 5:
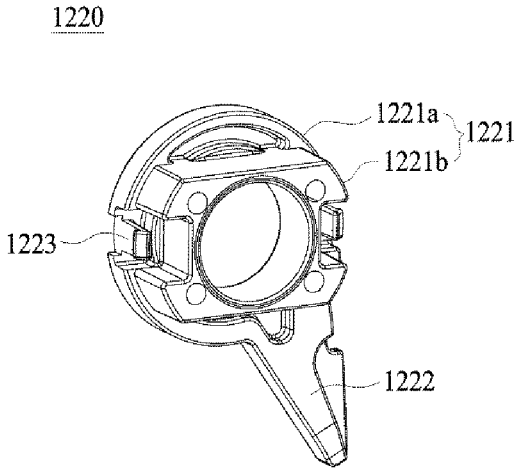
FIG. 5 is a perspective view of a rotating shaft part provided in the chin guard positioning assembly according to one embodiment of the present disclosure.

FIG. 4 is a perspective view of a fixed body part provided in the chin guard positioning assembly according to one embodiment of the present disclosure, and FIG. 5 is a perspective view of a rotating shaft part provided in the chin guard positioning assembly according to one embodiment of the present disclosure.

The fixed base part 1200 according to one embodiment of the present disclosure may include a fixed body part 1210 formed with a guide part 1211*a* configured to provide a predetermined path and a rotating shaft part 1220 which is rotated on the fixed base part 1200 so that a movable body part 1110 is connected to the rotating shaft part 1220 and rotated.

FIG. 4A is a front perspective view of the fixed body part provided in the chin guard positioning assembly according to one embodiment of the present disclosure, and FIG. 4B is a rear perspective view of the fixed body part provided in the chin guard positioning assembly according to one embodiment of the present disclosure.

Referring to FIG. 4, the fixed body part 1210 may include a fixed region part 1211 configured to provide a certain region where the movable base part 1100 may be seated and a position restricting assembly part 1212 configured to restrict the movement of the position of a movement connection part 1120 which will be described below.

The fixed region part 1211 having a plate shape may provide the certain region where the movable base part 1100 may be seated.

The fixed region part 1211 may be coupled to the helmet body 200.

For example, the fixed region part 1211 may be coupled to the helmet body 200 by fastening members (bolts) passing through a plurality of holes formed in the fixed region part 1211.

The guide part 1211*a* may be formed to pass through from one surface of the fixed region part 1211 to the other surface of the fixed region part 1211.

The movement connection part 1120 to be described below may be inserted into the guide part 1211*a*.

The movement connection part 1120 may be slid in the guide part 1211*a*.

The guide part 1211*a* may guide the movement connection part 1120 such that the position of the movement connection part 1120 may be moved in a predetermined path.

The position of the movement connection part 1120 may be moved only within a range in which the guide part 1211*a* is formed. Such a feature may be expressed as that the position of the movement connection part 1120 is moved along the predetermined path.

The guide part 1211*a* may be formed on the fixed region part 1211 in a lower side direction with respect to a shaft insertion hole 1211*g* which will be described below.

The guide part 1211*a* may be formed to pass through from one surface to the other surface of the fixed body part 1210 to be extended in one direction with a variable radius of curvature thereof.

Accordingly, an area of the fixed region part 1211 may be minimized.

The fixed body part 1210 may further include a guide protrusion 1211*b* formed to protrude from a rear surface of the fixed region part 1211 along a circumference of the guide part 1211*a*.

A second movement connection part 1120*b* to be described below may be seated on a rear surface of the guide protrusion 1211*b*, and the second movement connection part 1120*b* may be slid on the rear surface of the guide protrusion 1211*b*.

A certain space may be formed on the guide protrusion 1211*b* so that a pressing protrusion 1212*a*-3 to be described below may be disposed thereon.

Specifically, the certain space, from which the guide protrusion 1211*b* does not protrude so that the pressing protrusion 1212*a*-3 may be disposed thereon, may be formed in a portion of the circumference of the guide part 1211*a*.

The guide protrusion 1211*b* may prevent the fixed region part 1211 from being damaged due to the movement connection part 1120 and perform a function of forming the certain space on which the pressing protrusion 1212*a*-3 may be disposed.

A shield-guide part 1211*c* may be formed to pass through from one surface of the fixed region part 1211 to the other surface of the fixed region part 1211.

A movable insertion part 1560 to be described below may be inserted into the shield-guide part 1211*c*.

The movable insertion part 1560 may be slid in the shield-guide part 1211*c*.

The shield-guide part 1211*c* may guide the movable insertion part 1560 such that the position of the movable insertion part 1560 may be moved in a predetermined path.

The position of the movable insertion part 1560 may be moved only within a range in which the shield-guide part

1211*c* is formed. Such a feature may be expressed as that the position of the movable insertion part 1560 is moved along the predetermined path.

The shield-guide part 1211*c* may be formed on the fixed region part 1211 in an upper side direction with respect to the shaft insertion hole 1211*g* which will be described below.

A lower side circumference of one end portion of the shield-guide part 1211*c* may be recessed to form a first seating space S10.

A lower side circumference of the other end portion of the shield-guide part 1211*c* is recessed to form a second seating space S20 and a third seating space S30.

Here, the second seating space S20 and the third seating space S30 may be spaced apart from each other.

The second seating space S20 and the third seating space S30 may be formed sequentially in a direction toward the other end portion of the shield-guide part 1211*c*.

The movable insertion part 1560 may be seated on the first to third seating spaces S10 to S30.

Accordingly, the shield part 400 may be temporarily fixed at a certain position.

Here, the temporary fixing may mean that the position may not be moved when an external force equal to or less than a certain external force within a range of an unbreakable external force is applied, and the position may be moved when an external force exceeding the certain external force within the range of the unbreakable external force is applied.

The fixed body part 1210 may further include a first shield-guide protrusion 1211*d* formed to protrude from the rear surface of the fixed region part 1211 so as to be spaced apart from the shield-guide part 1211*c* and extend along an upper side circumference of the shield-guide part 1211*c*.

Also, the fixed body part 1210 may further include a second shield-guide protrusion 1211*e* formed to protrude from the rear surface of the fixed region part 1211 along a lower side circumference of the shield-guide part 1211*c*.

The first shield-guide protrusion 1211*d* may be spaced apart from the second shield-guide protrusion 1211*e*.

A movement rising part 1540 to be described below may be disposed between the first shield-guide protrusion 1211*d* and the second shield-guide protrusion 1211*e*.

As one specific example, the movement rising part 1540 may be slid while upper and lower surfaces of the movement rising part 1540 are brought into contact with a lower surface of the first shield-guide protrusion 1211*d* and an upper surface of the second shield-guide protrusion 1211*e*.

The movable insertion part 1560 may be slid on the upper surface of the second shield-guide protrusion 1211*e*.

The second shield-guide part protrusion 1211*e* may support the movable insertion part 1560 so that the movable insertion part 1560 may be slid smoothly.

The first shield-guide protrusion 1211*d* and the second shield-guide protrusion 1211*e* may guide the movement rising part 1540 so that the position of the movement rising part 1540 may be moved in a predetermined path.

Here, in the meaning in which the position is moved in the predetermined path, the detailed description may be omitted within a range overlapping with the above description.

The fixed body part 1210 may further include an open fixing part 1213 formed to protrude from the rear surface of the fixed region part 1211.

The open fixing part 1213 may be connected to the first shield-guide protrusion 1211*d*.

The open fixing part 1213 may provide a certain space in an inward direction thereof, and a movable protrusion 1550 to be described below may be inserted into the provided certain space.

A fixed seating part 1211*f* may be formed to pass through from one surface of the fixed region part 1211 to the other surface of the fixed region part 1211.

The position of the fixed magnetic force part 1300 may be fixed in the fixed seating part 1211*f*.

As one specific example, an area of the fixed seating part 1211*f* formed on the other surface of the fixed region part 1211 may be smaller than an area of the fixed seating part 1211*f* formed on one surface of the fixed region part 1211.

Accordingly, the fixed magnetic force part 1300 may be seated on the fixed seating part 1211*f* so that a position thereof may be fixed.

The shaft insertion hole 1211*g* may be formed to pass through from one surface of the fixed region part 1211 to the other surface of the fixed region part 1211.

The rotating shaft part 1220 may be inserted into the shaft insertion hole 1211*g*.

The position restricting assembly part 1212 may include a pressing part 1212*a* configured to press the movement connection part 1120 and a fixed elastic part 1212*b* configured to provide an elastic force to the pressing part 1212*a*.

The fixed elastic part 1212*b* may be made of an elastic material.

For example, the fixed elastic part 1212*b* may be a coil spring.

However, the present disclosure is not limited thereto, and the type of the fixed elastic part 1212*b* may be variously modified at a level that is obvious to those of ordinary skill in the art.

One end portion of the fixed elastic part 1212*b* may be connected to the fixed region part 1211, and the other end portion of the fixed elastic part 1212*b* may be connected to the pressing part 1212*a*.

The pressing part 1212*a* may include a pressing pivot part 1212*a*-1 connected to the fixed region part 1211, a pressing extension part 1212*a*-2 formed to protrude from a side surface of the pressing pivot part 1212*a*-1 in one direction, and the pressing protrusion 1212*a*-3 formed to protrude from an upper surface of the pressing extension part 1212*a*-2.

The pressing pivot part 1212*a*-1 may be connected to the fixed region part 1211 so as to be rotatable with respect to the fixed region part 1211.

For example, the pressing pivot part 1212*a*-1 may be connected to the fixed region part 1211 while a fastening member (for example, a bolt) is connected to the fixed region part 1211 through the pressing pivot part 1212*a*-1.

However, the present disclosure is not limited thereto, and the method in which the pressing pivot part 1212*a*-1 is connected to the fixed region part 1211 may be variously modified at a level that is obvious to those of ordinary skill in the art.

A lower surface of the pressing extension part 1212*a*-2 may be brought into contact with the fixed elastic part 1212*b*.

The pressing protrusion 1212*a*-3 may protrude to be inclined from the upper surface of the pressing extension part 1212*a*-2.

For example, the pressing protrusion 1212*a*-3 may have a triangular shape.

However, the present disclosure is not limited thereto, and the shape of the pressing protrusion 1212*a*-3 may be variously modified at a level that is obvious to those of ordinary skill in the art.

Referring to FIG. 5, the rotating shaft part 1220 may include a shaft part 1221 rotated on the fixed body part 1210 when the movable body part 1110 is connected and a position thereof is moved and include a protrusion 1222 formed to protrude from the shaft part 1221 in one direction.

Further, the rotating shaft part 1220 may further include a shaft fixing part 1223 configured to restrict the movement of the position of the shaft part 1221 in a direction opposite to a direction in which the shaft part 1221 is inserted into the shaft insertion hole 1211*g*.

One end portion of the shaft part 1221 may be connected to the movable base part 1100. Further, the protrusion 1222 may be formed to protrude from the other end portion of the shaft part 1221.

The shaft part 1221 may include a first shaft part 1221*a* seated on the rear surface of the fixed region part 1211 and a second shaft part 1221*b* formed to protrude from an upper surface of the first shaft part 1221*a* in one direction.

The first shaft part 1221*a* may have a circular plate shape having a certain thickness.

However, the present disclosure is not limited thereto, and the shape of the first shaft part 1221*a* may be variously modified at a level that is obvious to those of ordinary skill in the art.

The first shaft part 1221*a* may be brought into contact with the rear surface of the fixed region part 1211.

The protrusion 1222 may be formed to protrude from a portion of a side surface of the first shaft part 1221*a* in one direction.

A portion of the side surface of the first shaft part 1221*a* may be recessed, and the shaft fixing part 1223 may be connected in the recessed portion.

The shaft fixing part 1223 may be formed in a hook shape and brought into contact with an inner surface of the shaft insertion hole 1211*g*.

The second shaft part 1221*b* and the first shaft part 1221*a* may form a certain step.

Accordingly, the upper surface of the first shaft part 1221*a*, from which the second shaft part 1221*b* does not protrude, may be brought into contact with a lower surface of the fixed region part 1211.

The second shaft part 1221*b* may be inserted into the shaft insertion hole 1211*g*.

The second shaft part 1221*b* may be connected to the movable body part 1110.

At least a portion of a side surface of the rotating shaft part 1220 may be formed to be flat so that the movable body part 1110 may be slid thereon.

As one specific example, a portion of a side surface of the second shaft part 1221*b* may be flat, and a portion of the remaining portion may be formed to be rounded.

The side surface of the second shaft part 1221*b* may form two flat surfaces.

Here, the two flat side surfaces may be parallel to each other.

The side surface of the second shaft part 1221*b*, which is formed to be rounded, may be brought into contact with the inner surface of the shaft insertion hole 1211*g*, and accordingly, the rotating shaft part 1220 may be rotated in a state of being connected to the fixed region part 1211.

FIG. 6 is a perspective view of a movable base part according to one embodiment of the present disclosure.

Figure 6A:
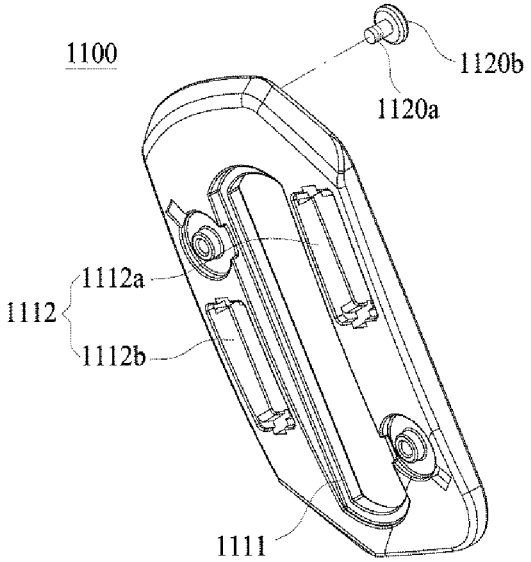
FIG. 6A is a front perspective view of the movable base part.
Figure 6B:
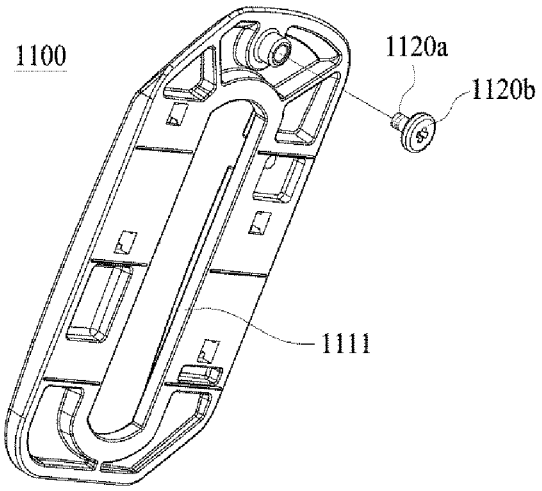
FIG. 6B is a rear perspective view of the movable base part.

Specifically, FIG. 6A is a front perspective view of the movable base part, and FIG. 6B is a rear perspective view of the movable base part.

Referring to FIG. 6, the movable base part 1100 may include the movable body part 1110 which provides a certain region on which the chin guard 300 is seated and to which the movable magnetic force part 1400 is fixed, and the movement connection part 1120 which is connected to the movable body part 1110 and simultaneously connected to the fixed base part 1200 and may be moved only in a predetermined path on the fixed body part 1210.

The movable body part 1110 may provide the certain region on which the chin guard 300 may be seated.

The chin guard 300 may be coupled to the movable body part 1110 by a fastening member.

A lead part 1111 into which the rotating shaft part 1220 is inserted and through which the rotating shaft part 1220 is slid when the position of the movable body part 1110 is moved may be formed in the movable body part 1110.

As one specific example, the lead part 1111 may be formed to pass through from one surface to the other surface of the movable body part 1110 so that the rotating shaft part 1220 may be inserted into the movable body part 1110.

The lead part 1111 may be formed to extend in one direction so that the rotating shaft part 1220 may be slid when the position of the movable body part 1110 is moved.

A portion of an upper surface of the movable body part 1110 is recessed to form a movable magnetic force seating part 1112 so that the movable magnetic force part 1400 may be seated therein.

The movable magnetic force seating part 1112 may include a first movable magnetic force seating part 1112*a* in which a first movable magnetic force part 1410 (see FIG. 8) to be described below is seated and a second movable magnetic force seating part 1112*b* in which a second movable magnetic force part 1420 (see FIG. 8) to be described below is seated.

The first movable magnetic force seating part 1112*a* and the second movable magnetic force seating part 1112*b* may be formed on the movable body part 1110 on both sides of the lead part 1111 with respect to the lead part 1111.

The movement connection part 1120 may be connected to a rear surface of the movable body part 1110 so as to protrude from the rear surface of the movable body part 1110.

The movement connection part 1120 may protrude from the movable body part 1110 in a direction opposite to a direction in which the chin guard 300 is disposed.

The movement connection part 1120 may include a first movement connection part 1120*a* connected to the movable body part 1110 and a second movement connection part 1120*b* connected to the first movement connection part 1120*a*.

A cross-sectional area of the second movement connection part 1120*b* may be wider than a cross-sectional area of the first movement connection part 1120*a*.

Accordingly, the second movement connection part 1120*b* may be slid on an upper surface of the guide part 1211*a*.

For example, the movement connection part 1120 may be a bolt, but the present disclosure is not limited thereto, and the shape of the movement connection part 1120 may be variously modified at a level that is obvious to those of ordinary skill in the art The movement connection part 1120 may be attached to or detached from the movable body part 1110.

Figure 7:
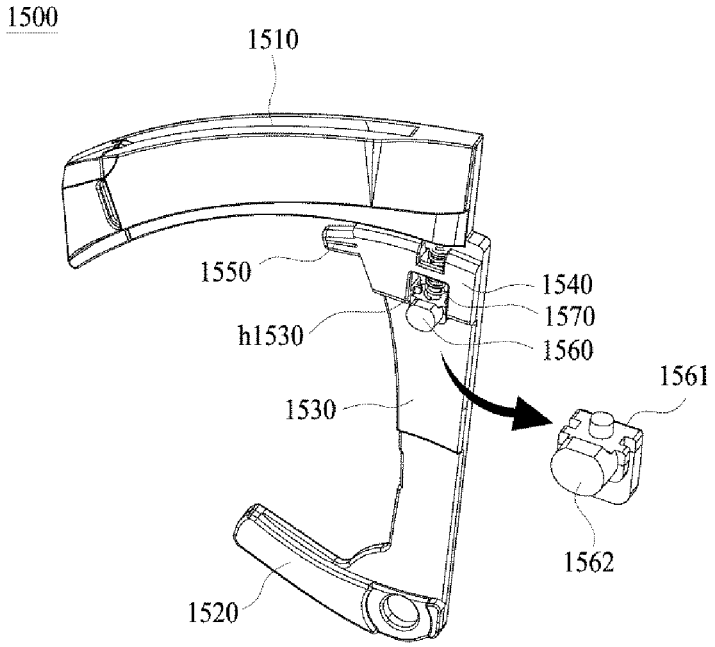
FIG. 7 is a perspective view of a shield moving part according to one embodiment of the present disclosure.

FIG. 7 is a perspective view of a shield moving part according to one embodiment of the present disclosure.

Referring to FIG. 7, a positioning assembly of the chin guard 300 according to one embodiment of the present disclosure may further include a shield moving part 1500, which is connected to the shield part 400 configured to protect the user's face, to implement the movement of the position of the shield part 400.

In other words, the positioning assembly of the chin guard 300 is connected to the shield part 400 configured to protect the user's face to implement the movement of the position of the shield part 400 and may further include the shield moving part 1500 which is seated on the fixed body part 1210 in a direction opposite to a direction in which the movable base part 1100 is seated on the fixed body part 1210.

The shield moving part 1500 may include a shield connection part 1510 connected to the shield part 400, a movement contact part 1520 which may be brought into contact with the protrusion 1222, and a movement extension part 1530 configured to connect the shield connection part 1510 and the movement contact part 1520 to each other.

Further, the shield moving part 1500 may further include the movement rising part 1540 protruding upward from an upper surface of the movement extension part 1530.

Also, the shield moving part 1500 may further include the movable protrusion 1550 protruding from the movement rising part 1540 in one direction.

The shield moving part 1500 may further include the movable insertion part 1560 inserted into the shield-guide part 1211*c* and a movement elastic part 1570 configured to provide an elastic force to the movable insertion part 1560.

In other words, the shield moving part 1500 may include the shield connection part 1510 disposed at an upper end portion of the fixed body part 1210 and connected to an end portion of the shield part 400, the movement contact part 1520 disposed on a lower end portion of the fixed body part 1210, and the movement extension part 1530 configured to connect the shield connection part 1510 and the movement contact part 1520 to each other.

The shield connection part 1510 may be formed to extend from one side surface of one end portion of the movement extension part 1530 in one direction.

The movement contact part 1520 may be formed to extend from one side surface of the other end portion of the movement extension part 1530 in one direction.

A separation distance between the movement contact part 1520 and the shield connection part 1510 may be gradually reduced as a distance from the movement extension part 1530 increases.

As one specific example, the movement extension part 1530 and the movement contact part 1520 may have an acute angle. Further, the movement extension part 1530 and the shield connection part 1510 may also have an acute angle.

An upper surface of the movement rising part 1540 may provide a certain region so as to be brought into contact with the rear surface of the fixed region part 1211.

The movement rising part 1540 may guide the shield moving part 1500 so that the shield moving part 1500 may be moved in a predetermined path.

As one specific example, the movement rising part 1540 may be disposed between the first shield-guide protrusion 1211*d* and the second shield-guide protrusion 1211*e*.

The movable protrusion 1550 may be inserted into the certain space provided by the open fixing part 1213.

The movable protrusion 1550 may be formed to extend from one side surface of the movement rising part 1540 in one direction.

An extension hole h1530 may be formed to pass through from one surface to the other surface of the movement extension part 1530 so that the movable insertion part 1560 may be disposed thereon.

The movable insertion part 1560 may be slid in the extension hole h1530.

The movable insertion part 1560 may include a first movable insertion part 1560 which is slid in the extension hole h1530 and a second movable insertion part 1562 which protrudes from the first movable insertion part 1560 in one direction and is inserted into the shield-guide part 1211*c*

The movement elastic part 1570 may be disposed in the extension hole h1530.

One end portion of the movement elastic part 1570 may be connected to the movement extension part 1530, and the other end portion of the movement elastic part 1570 may be connected to the movable insertion part 1560.

FIG. 8 is a coupled perspective view of the chin guard positioning assembly according to one embodiment of the present disclosure.

Figure 8A:
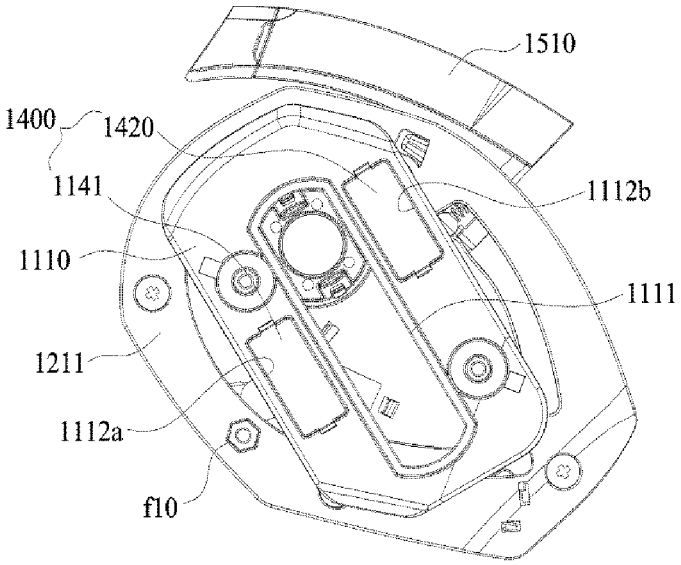
FIG. 8A is a coupled perspective view of a front surface of the chin guard positioning assembly according to one embodiment of the present disclosure.
Figure 8B:
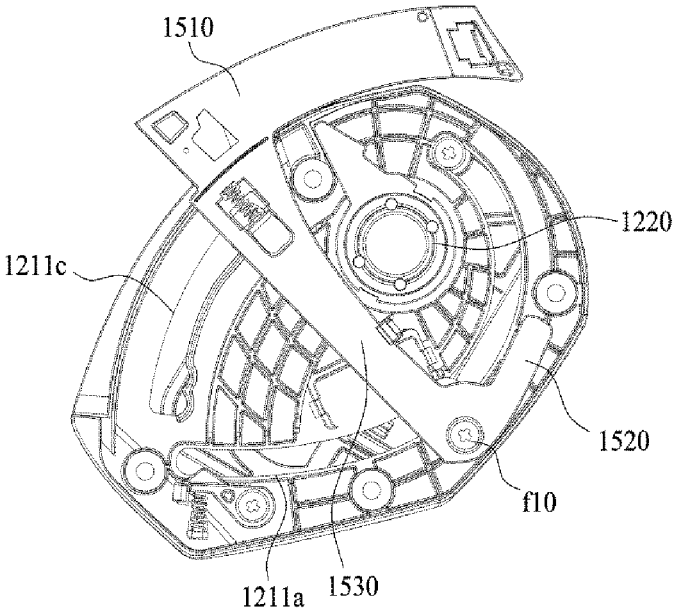
FIG. 8B is a coupled perspective view of a rear surface of the chin guard positioning assembly according to one embodiment of the present disclosure.

Specifically, FIG. 8A is a coupled perspective view of a front surface of the chin guard positioning assembly according to one embodiment of the present disclosure, and FIG. 8B is a coupled perspective view of a rear surface of the chin guard positioning assembly according to one embodiment of the present disclosure.

Referring to FIGS. 4 to 8, the rotating shaft part 1220 may be inserted into the shaft insertion hole 1211*g* and connected to the movable body part 1110.

As one specific example, the first shaft part 1221*a* may be seated on the rear surface of the fixed region part 1211, and the second shaft part 1221*b* may be inserted into the lead part 1111 through the shaft insertion hole 1211*g*.

The first movable magnetic force part 1410 may be disposed in the first movable magnetic force seating part 1112*a*, and the second movable magnetic force part 1420 may be disposed in the second movable magnetic force seating part 1112*b*.

The protrusion 1222 may be positioned on a rear surface side of the fixed region part 1211.

The rear surface of the movable body part 1110 may be brought into contact with an upper surface of the fixed region part 1211.

The first movement connection part 1120*a* may be connected to the rear surface of the movable body part 1110, and the second movement connection part 1120*b* may be seated on the rear surface of the guide protrusion 1211*b*.

The movement connection part 1120 may prevent the movable body part 1110 from being separated from the fixed region part 1211.

The shield moving part 1500 may be disposed on the rear surface side of the fixed region part 1211.

In other words, the shield moving part 1500 and the fixed region part 1211 may be disposed opposite to each other with respect to the fixed region part 1211.

The shield connection part 1510 may be brought into contact with an upper surface of an upper end portion of the fixed region part 1211.

The shield connection part 1510 may be disposed in an upper side direction of the upper end portion of the fixed region part 1211.

When the position of the shield part is moved, the shield connection part 1510 may be slid on the upper surface of the fixed region part 1211.

The movement contact part 1520 may be disposed in an upper side direction of a lower end portion of the fixed region part 1211.

The fixed region part 1211 and a portion in which the movement extension part 1530 is connected to the movement contact part 1520 may be coupled by a rotation fastening member f10.

Accordingly, when the position of the shield part 400 is moved, the shield moving part 1500 may rotate with respect to the portion in which the movement extension part 1530 is connected to the movement contact part 1520.

The movable insertion part 1560 may be inserted into the shield-guide part 1211*c*.

The movement elastic part 1570 may supply an external force to the movable insertion part 1560 so that the movable insertion part 1560 is brought into close contact with the second shield-guide protrusion 211*e*.

Figure 9:
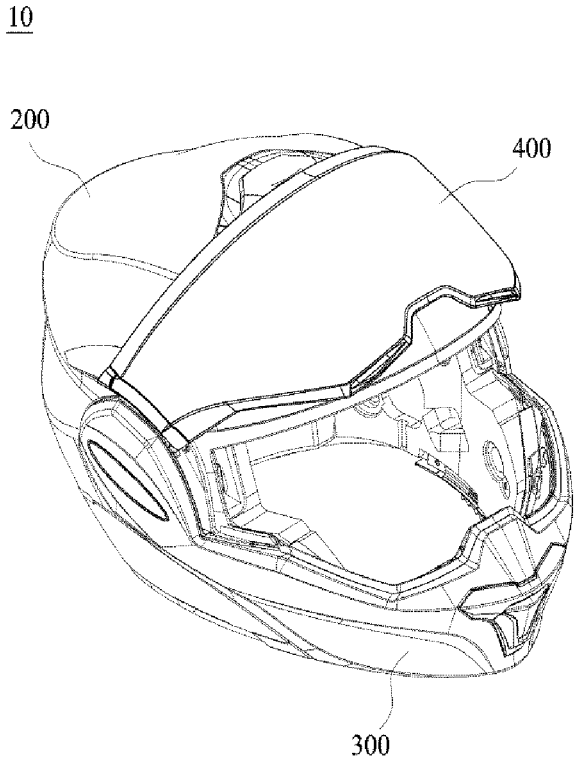
FIG. 9 is a view illustrating a state in which a shield part provided in the helmet according to one embodiment of the present disclosure is lifted.

FIG. 9 is a view illustrating a state in which the shield part provided in the helmet according to one embodiment of the present disclosure is lifted.

Referring to FIGS. 1 and 9, the position of the shield part 400 may be moved on the helmet body 200.

FIG. 1 may be a view illustrating a state in which the shield part 400 may protect the user's face.

Here, the shield part 400 may be brought into contact with the chin guard 300 in a protective position.

At this time, the position of the shield moving part 1500 may be referred to as a front position.

When the shield moving part 1500 is in the front position, the shield part 400 may protect the user's face.

FIG. 9 may be a view illustrating a state in which the shield part 400 may not protect the user's face.

Here, the shield part 400 may be separated from the chin guard 300 in the protective position.

Here, the position of the shield moving part 1500 may refer to as a rear position.

When the shield moving part 1500 is in the rear position, the shield part 400 may not protect the user's face.

Hereinafter, an operation of the positioning assembly of the chin guard 300 according to the movement of the position of the chin guard 300 will be described in detail.

The shield moving part 1500 may be rotated from the front position to the rear position so that the position thereof may be moved.

Further, the shield moving part 1500 may be rotated from the rear position to the front position so that the position thereof may be moved.

Accordingly, the position of the shield part 400 may also be moved.

First, a process in which the shield moving part 1500 is in the rear position and the position of the chin guard 300 is moved from the protective position to the open position will be described.

Hereinafter, reference numerals will be referred to FIGS. 1 to 9.

FIGS. 10 and 11 are views for describing a process in which the position of the chin guard provided in the helmet according to one embodiment of the present disclosure is moved from the protective position to the open position, FIGS. 12 and 13 are views for describing an operation process of the chin guard positioning assembly in the process shown in FIGS. 10 and 11, and FIGS. 14 and 15 are views for describing the operation process of the chin guard positioning assembly in the process shown in FIGS. 10 and 11.

Figure 10A:
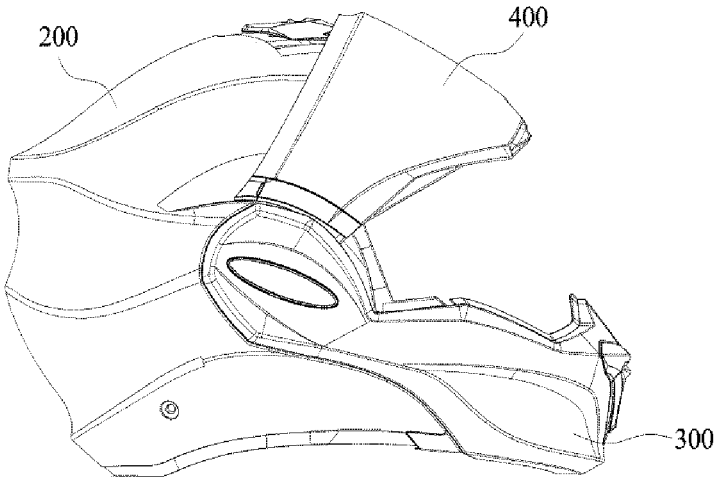
FIGS. 10A, 10B, 11A, 11B and 11C are views for describing a process in which the position of the chin guard is moved from a protective position to an open position when the shield moving part provided in the helmet according to one embodiment of the present disclosure is in a rear position.
Figure 12A:
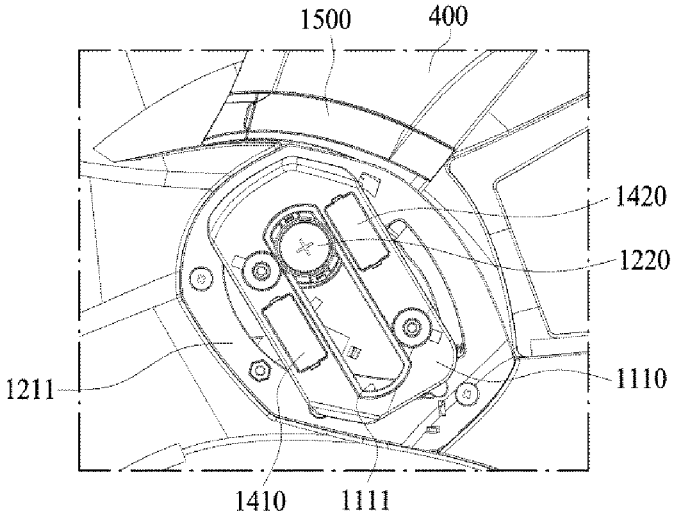
FIGS. 12A, 12B, 13A, 13B and 13C are views for describing the operation process of the chin guard positioning assembly in the process shown in FIGS. 10A, 10B, 11A, 11B and 11C.
Figure 14A:
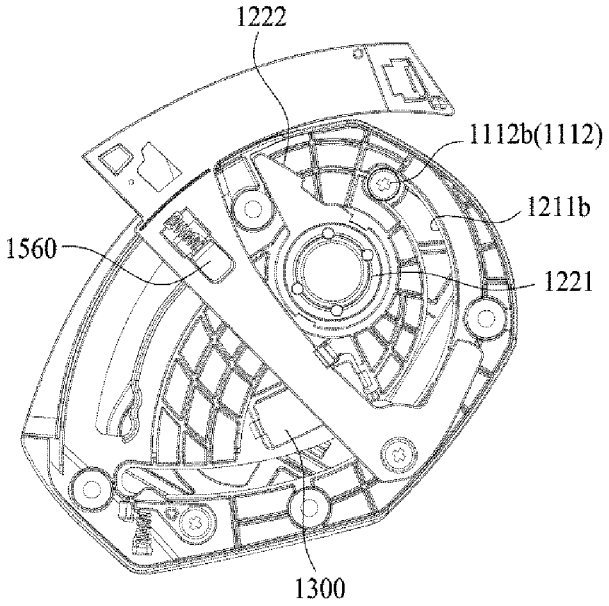
FIGS. 14A, 14B, 15A, 15B and 15C are views for describing the operation process of the chin guard positioning assembly in the process shown in 10A, 10B, 11A, 11B and 11C.

Specifically, FIGS. 12A and 14A are views illustrating the position of the chin guard positioning assembly when the chin guard and the shield part are in the positions of FIG. 10A.

Figure 10B:
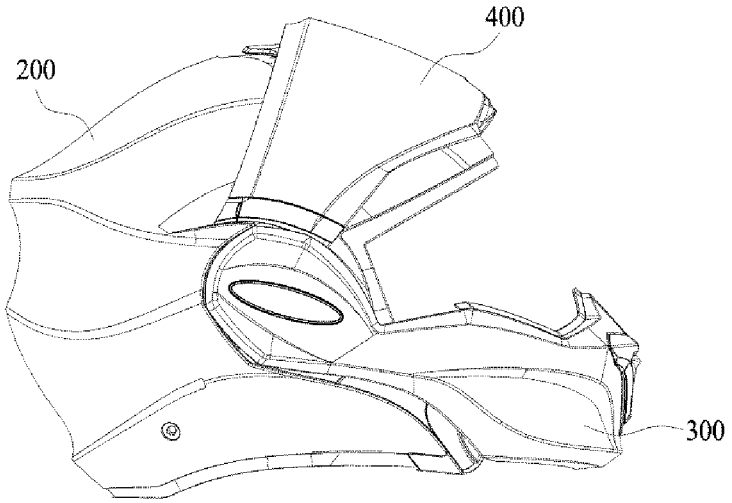
Figure 12B:
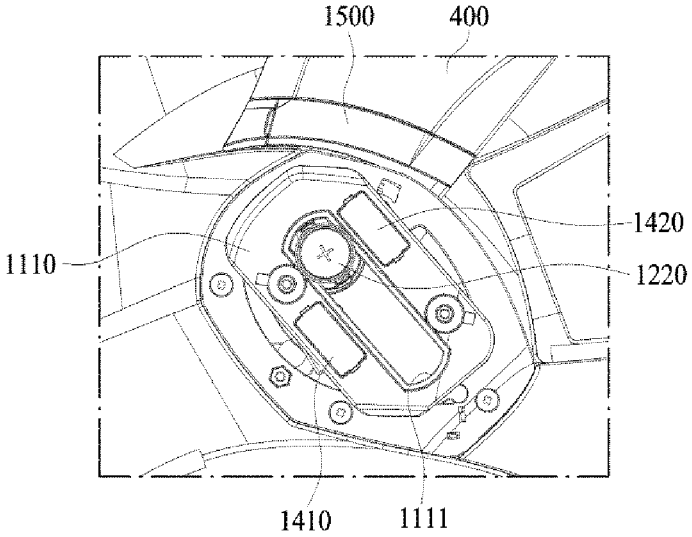
Figure 14B:
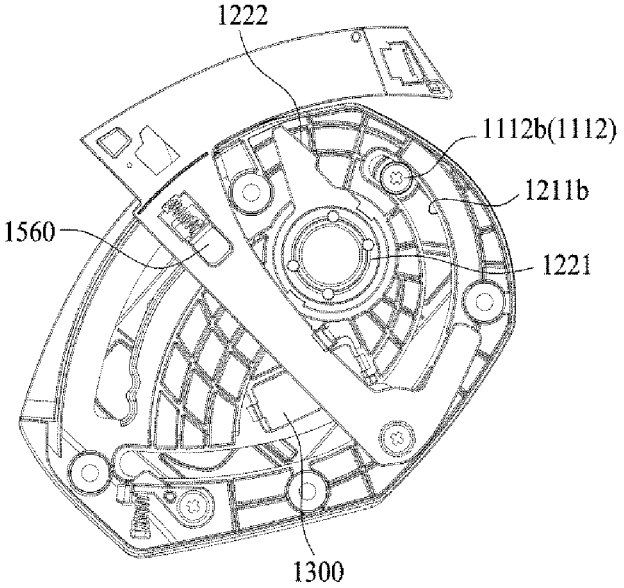

Further, FIGS. 12B and 14B are views illustrating the position of the chin guard positioning assembly when the chin guard and the shield part are in the positions of FIG. 10B.

Figure 11A:
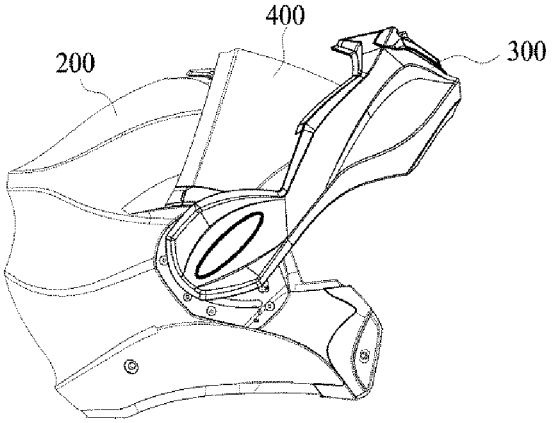
Figure 13A:
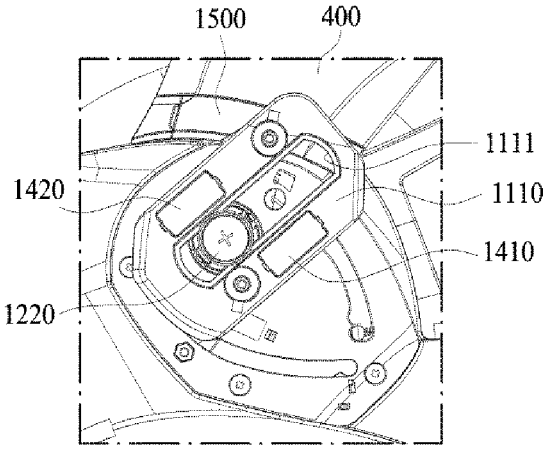
Figure 15A:
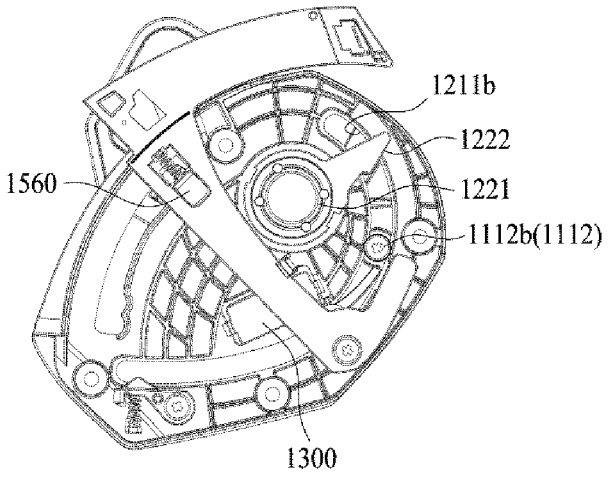

Further, FIGS. 13A and 15A are views illustrating the position of the chin guard positioning assembly when the chin guard and the shield part are in the positions of FIG. 11A.

Figure 11B:
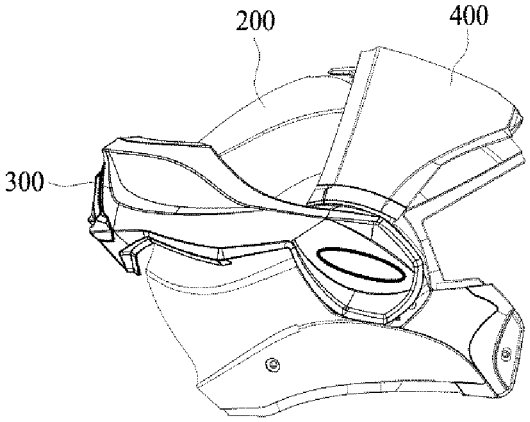
Figure 13B:
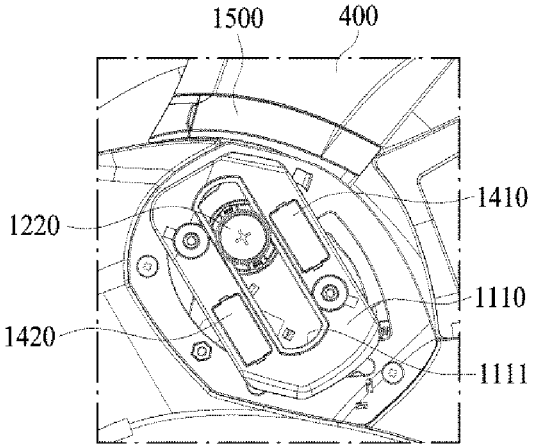
Figure 15B:
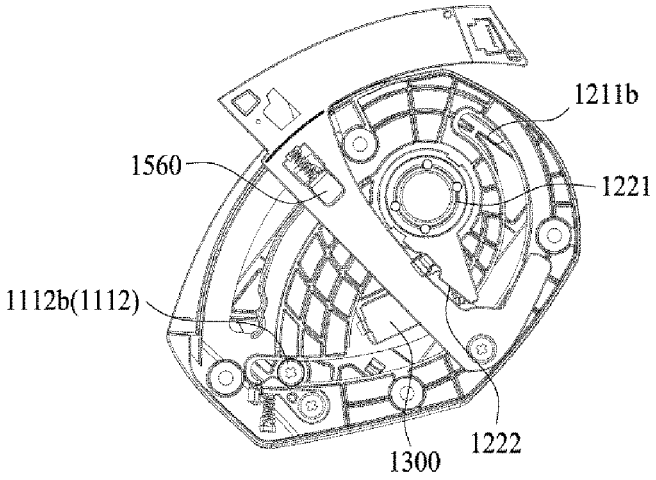

Further, FIGS. 13B and 15B are views illustrating the position of the chin guard positioning assembly when the chin guard and the shield part are in the positions of FIG. 11B.

Figure 11C:
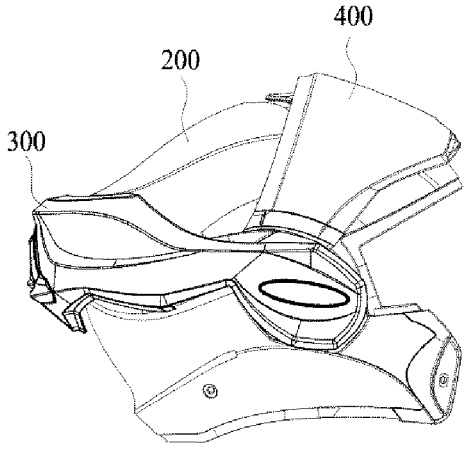
Figure 13C:
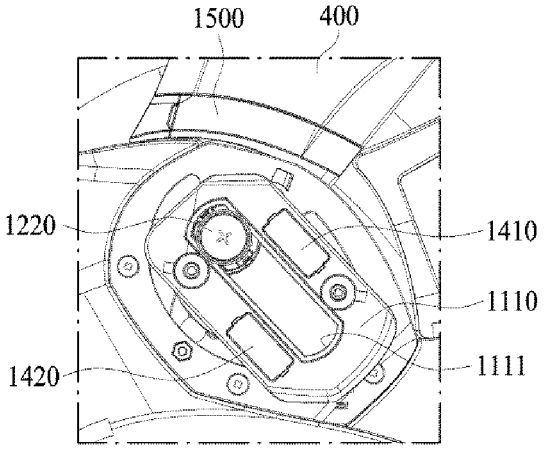
Figure 15C:
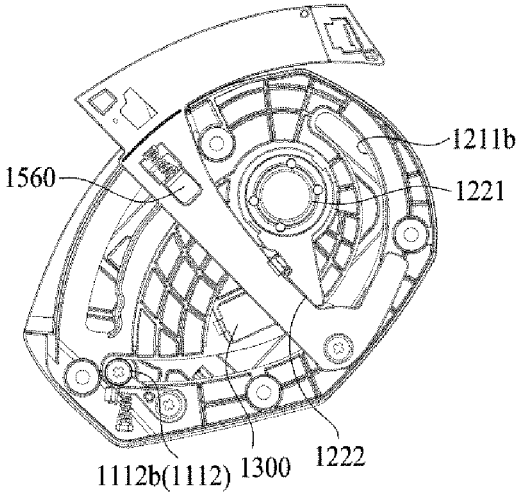

Further, FIGS. 13C and 15C are views illustrating the position of the chin guard positioning assembly when the chin guard and the shield part are in the positions of FIG. 11C.

FIGS. 10A, 12A, and 14A may be views illustrating a case in which the chin guard 300 is in the protective position.

When the chin guard 300 is in the protective position, the chin guard 300 may be directly coupled to the helmet body 200.

Although the direct coupling of the chin guard 300 to the helmet body 200 is not shown in the drawings in detail, the direct coupling may be utilized by adopting various fastening methods at a level that is obvious to those of ordinary skill in the art in system helmets.

When the shield moving part 1500 is in the rear position, the movable protrusion 1550 may be inserted into the space provided by the open fixing part 1213.

Further, the movable insertion part 1560 may be disposed on the first seating space S10.

The movement elastic part 1570 may press the movable insertion part 1560 so that the movable insertion part 1560 is brought into close contact with the upper surface of the second shield-guide protrusion 1211*e* forming the first seating space S10.

Referring to FIGS. 10B, 12B, and 14B, when the fastening between the chin guard 300 and the helmet body 200 is released, the chin guard 300 may rotate from the protective position toward the open position.

This may be because the chin guard 300 rotates in an upward direction by attraction between the fixed magnetic force part 1300 and the first movable magnetic force part 1410.

The movable magnetic force part 1400 may include the first movable magnetic force part 1410 which interacts with the magnetic force of the fixed magnetic force part 1300 when the movable base part 1100 is in the first position.

Here, the movable body part 1110 may also rotate in an upward direction according to the movement of the position of the chin guard 300, and, as a result, the rotating shaft part 1220 may rotate, and the second movement connection part 1120*b* may also be slid on the guide protrusion 1211*b*.

FIGS. 10B, 12B, and 14B may be views illustrating the case in which the movable base part 1100 is in the first position.

The first position may be a position closer to the position of the movable base part 1100 when the chin guard 300 is in the protective position than the position of the movable base part 1100 when the chin guard 300 is in the open position.

At this time, the attraction between the fixed magnetic force part 1300 and the first movable magnetic force part 1410 may be maximized.

Referring to FIGS. 11A, 13A, and 15A, the movable body part 1110 may be slid on the rotating shaft part 1220 corresponding to the movement of the position of the movement connection part 1120 so that a separation distance between the rotating shaft part 1220 and the movement connection part 1120 is changed when the position of the movable base part 1100 is moved from the first position to the second position.

Specifically, the second movement connection part 1120*b* may be slid on the guide protrusion 1211*b* when the position of the chin guard 300 is continuously moved toward the open position.

Here, since the radius of curvature of the guide part 1211*a* continuously varies, a separation distance between the second movement connection part 1120*b* and the rotating shaft part 1220 may vary.

Accordingly, the rotating shaft part 1220 may be slid in the lead part 1111.

For example, the rotating shaft part 1220 may be brought into contact with one end portion of the lead part 1111 when the movable base part 1100 is in the first position.

The rotating shaft part 1220 may be slid in the lead part 1111 from one end portion of the lead part 1111 toward the other end portion of the lead part 1111 as the position of the chin guard 300 is moved from the protective position to the open position.

When the position of the chin guard 300 is moved from the state shown in FIG. 10B to the state shown in FIG. 11A, the interaction between the first movable magnetic force part 1410 and the fixed magnetic force part 1300 may be gradually weakened.

Here, the interaction may refer to attraction due to the magnetic force.

When the chin guard 300 is continuously positioned in the open position in the state shown in FIG. 11A, the second movable magnetic force part 1420 and the fixed magnetic force part 1300 may interact with each other.

FIGS. 11B, 13B, and 15B may be views illustrating the case in which the movable base part 1100 is in the second position.

The second position may be a position closer to the position of the movable base part 1100 when the chin guard 300 is in the open position than the position of the movable base part 1100 when the chin guard 300 is in the protective position.

The movable magnetic force part 1400 may include the second movable magnetic force part 1420 which is spaced apart from the first movable magnetic force part 1410 so as to interact with the magnetic force of the fixed magnetic force part 1300 when the movable base part 1100 is in the second position.

The first movable magnetic force part 1410 may be disposed to face the second movable magnetic force part 1420 with respect to the lead part 1111.

When the movable base part 1100 is moved from the first position to the second position, in the beginning, the attraction between the fixed magnetic force part 1300 and the first movable magnetic force part 1410 may be gradually decreased, and then attraction between the fixed magnetic force part 1300 and the second movable magnetic force part 1420 may be gradually increased.

Accordingly, in a section in which the attraction between the fixed magnetic force part 1300 and the second movable magnetic force part 1420 is gradually increased, the user may rotate the chin guard 300 even when the user applies a small amount of external force to the chin guard 300

Since the helmet user usually wears a thick coat, it is inconvenient for the user to move the chin guard 300 to the open position, but according to the positioning assembly of the chin guard 300 according to one embodiment of the present disclosure, the position of the chin guard 300 may be automatically moved to the vicinity of the open position by the magnetic force even when the user rotates the chin guard 300 in the protective position only to a certain position.

Referring to FIGS. 11B, 13B, and 15B, the attraction between the fixed magnetic force part 1300 and the second movable magnetic force part 1420 may be maximized.

The second movement connection part 1120*b* may be brought into contact with the pressing protrusion 1212*a*-3.

The position of the second movement connection part 1120*b* may not be moved by the pressing protrusion 1212*a*-3.

FIGS. 11C, 13C, and 15C are views illustrating the state in which the chin guard 300 is in the open position.

In the state of FIG. 11B, the position of the chin guard 300 may be moved to the open position by applying an external force to the chin guard 300 by a worker.

Here, the fixed elastic part 1212*b* is contracted so that the position of the second movement connection part 1120*b* positioned at one side of the pressing protrusion 1212*a*-3 may be moved in the other side direction of the pressing protrusion 1212*a*-3.

When the second movement connection part 1120*b* is positioned at the other side of the pressing protrusion 1212*a*-3, the fixed elastic part 1212*b* may expand and the position of the second movement connection part 1120*b* may be fixed.

The position of the chin guard 300 may be fixed in the open position by the position restricting assembly part 1212.

When the chin guard 300 is in the open position, the rotating shaft part 1220 may be brought into contact with the other end portion of the lead part 1111.

Further, the protrusion 1222 may be brought into contact with the movement extension part 1530.

The above description may be the description of the process in which the position of the chin guard 300 is moved from the protective position to the open position when the shield moving part 1500 is in the rear position.

The operation in which the position of the chin guard 300 is moved from the open position to the protective position when the shield moving part 1500 is in the front position is an operation opposite to the above-described process, and thus a detailed description thereof may be omitted.

For example, the process, in which the position of the chin guard 300 is moved from the protective position to the open position when the shield moving part 1500 is in the rear position, may be a process in which FIGS. 10A, 10B, 11A, 11B, and 11C are sequentially performed, and the process, in which the position of the chin guard 300 is moved from the open position to the protective position when the shield moving part 1500 is in the front position, may be a process in which FIGS. 11C, 11B, 11A, 10B, and 10A are sequentially performed.

When the position of the movable base part 1100 is moved from the second position to the first position, the movable body part 1110 may be slid on the rotating shaft part 1220 corresponding to the movement of the position of the movement connection part 1120 so that the separation distance between the rotating shaft part 1220 and the movement connection part 1120 is changed.

Hereinafter, a process in which the shield moving part 1500 is in the front position and the position of the chin guard 300 is moved from the open position to the protective position will be described.

FIGS. 16 and 17 are views for describing a process in which the position of the chin guard is moved from the open position to the protective position when the shield moving part provided in the helmet according to one embodiment of the present disclosure is in the front position, and FIGS. 18 and 19 are views for describing an operation process of the chin guard positioning assembly in the process shown in FIGS. 16 and 17.

When the movable base part 1100 is brought into contact with the rotating shaft part 1220, and the position of the movable base part 1100 is moved from the second position to the first position, the position of the shield moving part 1500 may be moved from the front position to the rear position according to the rotation of the rotating shaft part 1220.

When the movable base part 1100 is brought into contact with the protrusion 1222 and the position of the movable base part 1100 is moved from the second position to the first position, the position of the shield moving part 1500 may be moved from the front position to the rear position according to the rotation of the protrusion 1222.

When the shield moving part 1500 is in the front position, the movement extension part 1530 may be disposed at a position which is in conflict with a movement path of the protrusion 1222 while the movable base part 1100 is rotated.

Figure 16A:
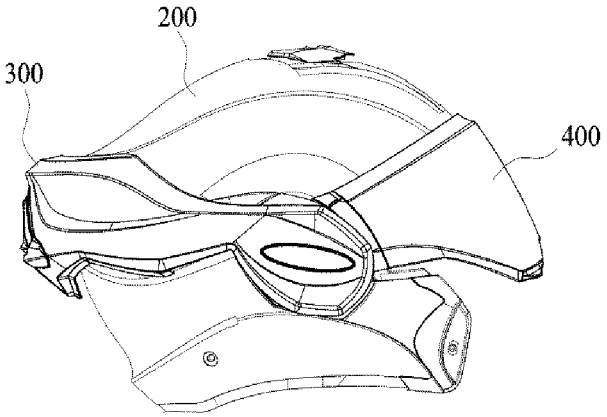
FIGS. 16A, 16B, 17A and 17B are views for describing a process in which the position of the chin guard is moved from the open position to the protective position when the shield moving part provided in the helmet according to one embodiment of the present disclosure is in a front position.
Figure 18A:
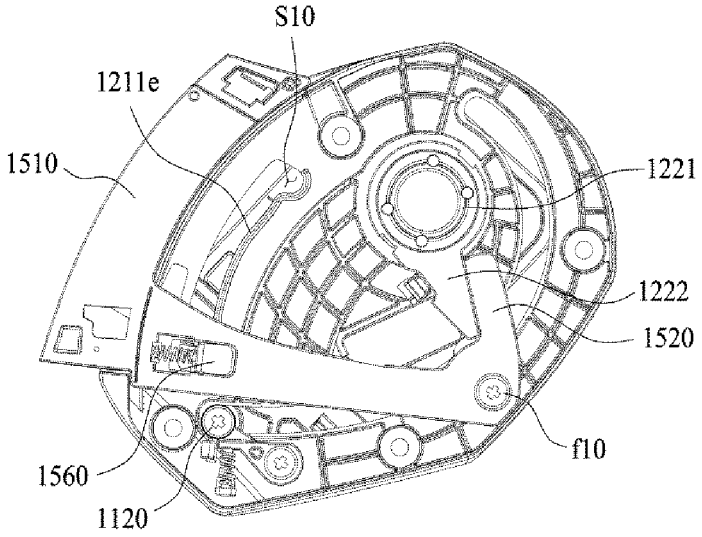
FIGS. 18A, 18B, 19A and 19B are views for describing the operation process of the chin guard positioning assembly in the process shown in FIGS. 16A, 16B, 17A and 17B.

FIGS. 16A and 18A are views illustrating the case in which the shield moving part 1500 is in the front position and the chin guard 300 is in the open position.

When the shield moving part 1500 is in the front position, the movable protrusion 1550 may be disposed at the third seating space S30.

Further, when the shield moving part 1500 is in the front position, and the chin guard 300 is in the open position, the protrusion 1222 and the movement contact part 1520 may be brought into contact with each other.

Since the position of the movable base part 1100 is determined by the position of the chin guard 300, technical features related to the position of the movable base part 1100 when the chin guard 300 is in the open position may be omitted within a range overlapping with the above description.

Figure 16B:
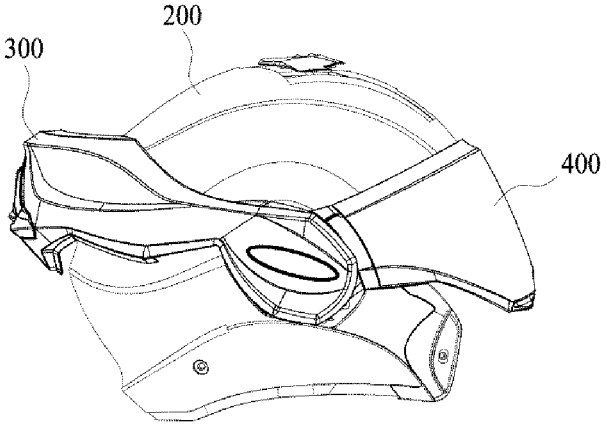
Figure 18B:
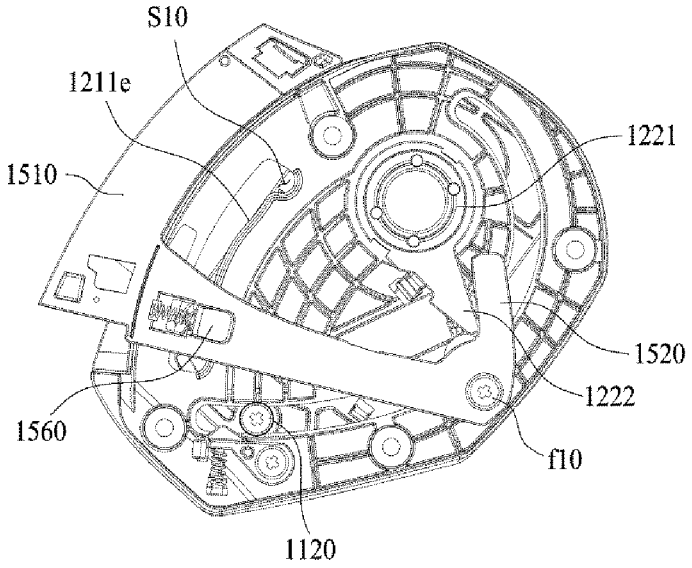

FIGS. 16B and 18B illustrate the state in which the movable base part 1100 is in the second position.

When an external force is applied to the chin guard 300 in the open position to rotate the chin guard 300 toward the protective position, the rotating shaft part 1220 may also be rotated in the same direction.

The protrusion 1222 may push the movement contact part 1520 while the rotating shaft part 1220 is rotated, and, accordingly, the shield moving part 1500 is also rotated so that the position of the movable insertion part 1560 may be moved from the third seating space S30 to the second seating space S20.

The shield moving part 1500 may also be rotated from the rear position toward the front position according to the rotation of the shield moving part 1500.

Figure 17A:
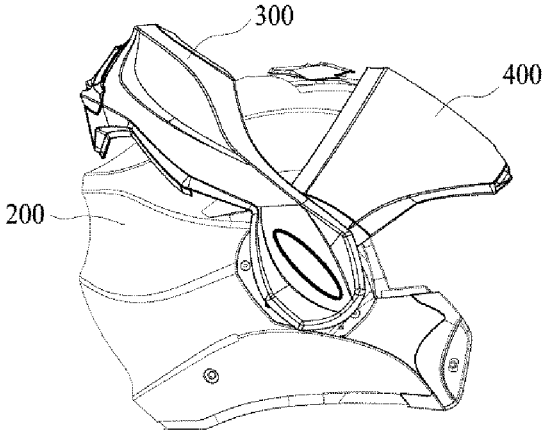
Figure 19A:
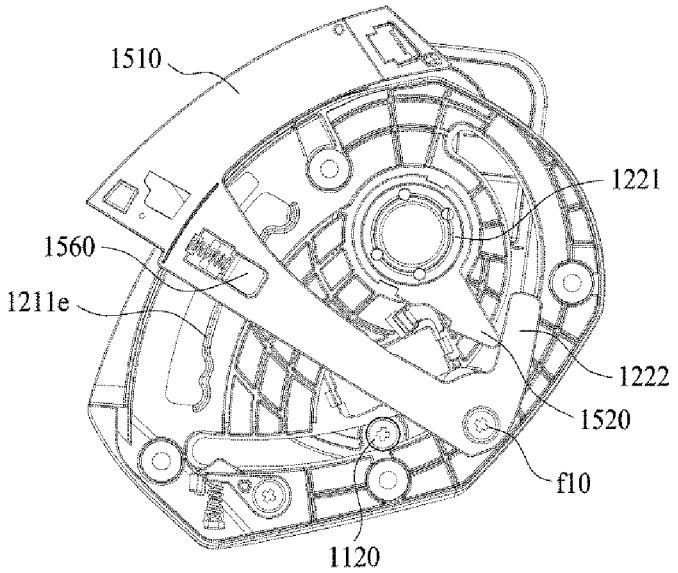

Referring to FIGS. 17A and 19A, when the chin guard 300 is continuously rotated from the open position toward the protective position in a state in which the movable base part 1100 is in the second position, the rotating shaft part 1220 may also be rotated and the shield moving part 1500 may also be continuously rotated by the rotation of the protrusion 1222.

Figure 17B:
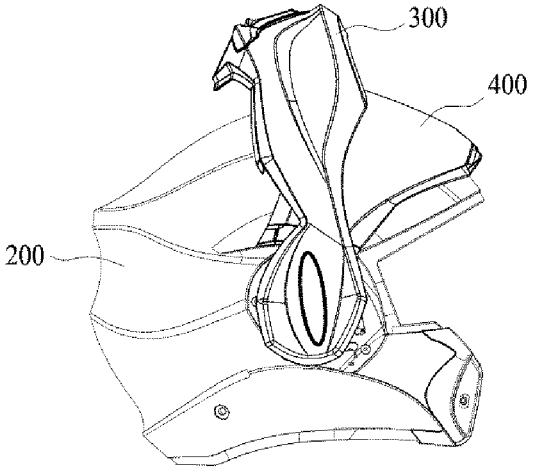
Figure 19B:
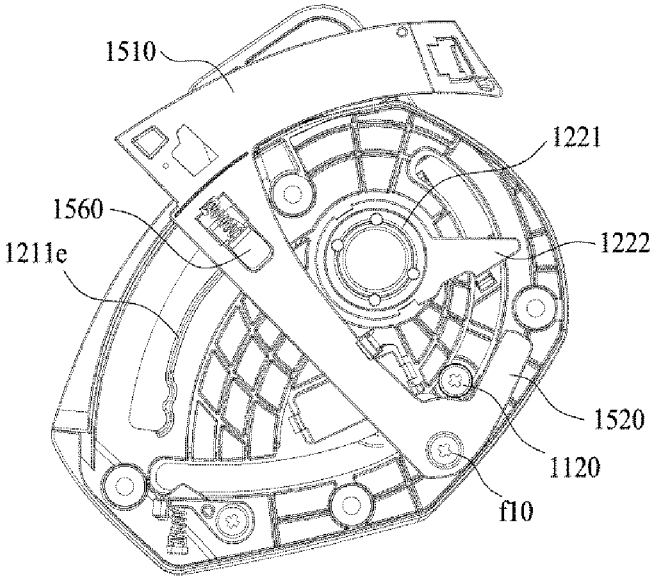

Referring to FIGS. 17B and 19B, when the chin guard 300 is continuously rotated from the open position toward the protective position, the shield moving part 1500 may be rotated until the movable protrusion 1550 is inserted into the space which is provided by the open fixing part 1213.

When the shield moving part 1500 is positioned at the front position, the protrusion 1222 may not be brought into contact with the movement contact part 1520, and the shield moving part 1500 may not be rotated even when the protrusion 1222 is rotated.

When the chin guard 300 is rotated from the open position toward the protective position in the state shown in FIGS. 17B and 19B, the states shown in FIGS. 15A, 14B and 14A are sequentially performed, and thus the detailed description may be omitted within a range overlapping with the above description.

Hereinafter, a process in which the shield moving part 1500 is in the front position and the position of the chin guard 300 is moved from the protective position to the open position will be described.

The chin guard 300 in the protective position may be rotated so that the position thereof is moved toward the open position in the state in which the shield moving part 1500 is in the front position.

Accordingly, the movable base part 1100 may be rotated together with the rotating shaft part 1220.

The chin guard 300 and the shield part 400 may be brought into contact with each other while the chin guard 300 is rotated from the protective position to the open position.

When the chin guard 300 and the shield part 400 are brought into contact with each other, the shield part 400 may be rotated together with the chin guard 300 while the chin guard 300 is rotated.

As the shield part 400 is rotated, the shield moving part 1500 may also be rotated.

The shield moving part 1500 may be rotated until the movable insertion part 1560 in the third seating space S30 is disposed in the first seating space S10.

Accordingly, the shield moving part 1500 may be positioned at the rear position.

When the shield moving part 1500 is positioned at the rear position, the shield part 400 may not be rotated any more, and only the chin guard 300 may be rotated.

The chin guard 300 may be rotated to the open position by being spaced apart from the shield part 400 when the shield moving part 1500 is in the rear position, and a detailed description thereof may be omitted within a range overlapping with the above description.

The helmet according to one embodiment of the present disclosure may include the helmet body 200 configured to provide the certain space into which the user's head may be inserted, the chin guard 300 in which the position thereof may be moved from the protective position, which is the position where the user's chin may be protected, to the open position, which is the position where the user's chin may not be protected, or moved from the open position to the protective position, and the chin guard positioning assembly 1000 configured to connect the helmet body 200 and the chin guard 300 to each other.

Here, the chin guard positioning assembly 1000 may include the movable base part 1100 which provides the certain region to which the chin guard 300 may be connected and in which the position thereof is moved together with the chin guard 300 when the position of the chin guard 300 is moved, the fixed base part 1200 connected to the helmet body 200 and connected to the movable base part 1100 to serve as the reference for the movement of the position of the movable base part 1100, the fixed magnetic force part 1300 fixed to the fixed base part 1200, and the movable magnetic force part 1400 fixed to the movable base part 1100 to fix the movable base part 1100 to the first position or the second position by interacting with the magnetic force of the fixed magnetic force part 1300.

According to a chin guard positioning assembly according to the present disclosure and a helmet having the same, manufacturing process times can be shortened.

Further, a failure rate due to long use can be reduced.

Further, a chin guard can be opened and closed with a minimum external force affecting distance.

Further, manufacturing costs can be reduced.

The effects of the present disclosure are not limited to the above-mentioned effects, and effects not mentioned above should be understood by a person of ordinary skill in the art to which the disclosure pertains from this disclosure and the accompanying drawings.

In order to more clearly describe the technical spirit of the present disclosure, the attached drawings are simply expressed or omitted for the components which are irrelevant to or less relevant to the technical spirit of the present disclosure.

While the present disclosure has been described with reference to the exemplary embodiments thereof, it should be understood that the disclosure is not limited thereto, and a person of ordinary skill in the art to which the disclosure pertains may make modifications and variations thereto, and such modifications or variations are within the scope of the appended claims.

What is claimed is:

1. A chin guard positioning assembly configured to connect a helmet body and a chin guard to each other, wherein the helmet body provides a space configured to receive a head of a user and a position of the chin guard is configured to be moved from a protective position, wherein a chin of the user is protected, to an open position, wherein the chin of the user is not protected, or is configured to be moved from the open position to the protective position, the chin guard positioning assembly comprising:

a movable base configured to be connected to the chin guard and configured to move together with the chin guard when the chin guard is moved;

a fixed base configured to be connected to the helmet body, and connected to the movable base, the movable base being rotatably connected to the fixed base;

a fixed magnetic force part fixed to the fixed base; and a movable magnetic force part fixed to the movable base, the movable magnetic force part fixing the movable base at a first movable-base position and at a second movable-base position by magnetically interacting with the fixed magnetic force part;

wherein the movable magnetic force part includes a first movable magnetic force part which magnetically interacts with the fixed magnetic force part when the movable base is in the first movable-base position and a second movable magnetic force part which is spaced apart from the first movable magnetic force part, the second movable magnetic force part magnetically interacting with the fixed magnetic force part when the movable base is in the second movable-base position.

2. The chin guard positioning assembly of claim 1, wherein the first movable-base position is a position closer to a position of the movable base when the chin guard is in the protective position than a position of the movable base when the chin guard is in the open position, and the second movable-base position is a position closer to a position of the movable base part when the chin guard is in the open position than a position of the movable base when the chin guard is in the protective position.

3. The chin guard positioning assembly of claim 1, wherein the movable base includes a movable body part having a seat configured to support the chin guard and to which the movable magnetic force part is fixed and includes a movement connection part which is connected to the movable body part and simultaneously connected to the fixed base and moved only in a predetermined path on the fixed base, the fixed base includes a fixed body part formed with a guide part configured to provide the predetermined path and a rotating shaft part which is rotatably connected to the fixed body part, the rotating shaft part being connected to the movable base to allow the movable base to be rotated, and the movable body part is slid on the rotating shaft part corresponding to a movement of a position of the movement connection part to allow a separation distance between the rotating shaft part and the movement connection part to be changed when a position of the movable base is moved from the first movable-base position to the second movable-base position or from the second movable-base position to the first movable-base position.

4. The chin guard positioning assembly of claim 3, wherein at least a portion of a side surface of the rotating shaft part is formed to be flat to allow the movable body part to be slid on the at least the portion of the side surface of the rotating shaft part.

5. The chin guard positioning assembly of claim 3, wherein the guide part is formed to pass through from one surface to another surface of the fixed body part so that a radius of curvature of the guide part is variably extended in one direction, and the movement connection part is inserted into the guide part.

6. The chin guard positioning assembly of claim 3, wherein the movable body part is formed with a lead part into which the rotating shaft part is inserted and through which the rotating shaft part is slid when the position of the movable body part is moved, and the first movable magnetic force part is disposed to face the second movable magnetic force part with respect to the lead part.

7. A chin guard positioning assembly configured to connect a helmet body and a chin guard to each other, wherein the helmet body provides a space configured to receive a head of a user and a position of the chin guard is configured to be moved from a protective position, wherein a chin of the user is protected, to an open position, wherein the chin of the user is not protected, or configured to be moved from the open position to the protective position, the chin guard positioning assembly comprising:

a movable base configured to be connected to the chin guard and configured to move together with the chin guard when the chin guard is moved;

a fixed base configured to be connected to the helmet body, and connected to the movable base for a movement of a position of the movable base relative to the fixed base;

a fixed magnetic force part fixed to the fixed base;

a movable magnetic force part fixed to the movable base, the movable magnetic force part fixing the movable base at a first movable-base position and at a second movable-base position by magnetically interacting with the fixed magnetic force part; and a shield moving part configured to be connected to a shield part for protecting a face of the user, the shield moving part configured to implement a movement of a position of the shield part, wherein the shield moving part is configured to move between a front position in which the shield part protects the user's face and a rear position in which the shield part does not protect the user's face, the fixed base includes a fixed body part configured to be connected to the helmet body and a rotating shaft part which is rotatably connected to the fixed body, the rotating shaft part being connected to the movable base to allow the movable base to be rotated, and when the movable base is brought into contact with the rotating shaft part, and the movable base is moved from the second movable-base position to the first movable-base position, the position of the shield moving part is moved from the front position to the rear position according to the rotation of the rotating shaft part.

8. The chin guard positioning assembly of claim 7, wherein the rotating shaft part includes a shaft part which is connected to the movable body part, the shaft part being rotated on the fixed body part when the movable body part is moved and a protrusion formed to protrude from the shaft part in one direction, and when the movable base is brought into contact with the protrusion and a position of the movable base is moved from the second movable-base position to the first movable-base position, the position of the shield moving part is moved from the front position to the rear position according to the rotation of the protrusion.

9. The chin guard positioning assembly of claim 8, wherein the shield moving part includes a shield connection part connected to the shield part, a movement contact part which is brought into contact with the protrusion, and a movement extension part configured to connect the shield connection part and the movement contact part to each other, the movement extension part including two end portions;

the shield connection part is formed to extend from one side surface of one end portion of the movement extension part in one direction, and the movement contact part is formed to extend from one side surface of the other end portion of the movement extension part in one direction.

10. A chin guard positioning assembly configured to connect a helmet body and a chin guard to each other, wherein the helmet body provides a space configured to receive a head of a user and a position of the chin guard is configured to be moved from a protective position, wherein a chin of the user is protected, to an open position, wherein the chin of the user is not protected, or configured to be moved from the open position to the protective position, the chin guard positioning assembly comprising:

a movable base having a movable-base seat configured to support and connect the chin guard to the movable base;

a fixed body configured to be connected to the helmet body, the fixed body having a fixed-body seat supporting the movable base;

a rotating shaft part which is rotatably connected to the fixed body, the rotating shaft part being connected to the movable base to allow the movable base to be rotated;

a fixed magnetic force part fixed to the fixed body; and a movable magnetic force part which is fixed to the movable base and is configured to interact with a magnetic force of the fixed magnetic force part to allow the movable base to be fixed at a selected position of the movable base, the selected position being one of a first position of the movable base or a second position of the movable base while the movable base is rotated by the rotating shaft part, wherein the movable magnetic force part includes a first movable magnetic force part located to interact with the magnetic force of the fixed magnetic force part when the movable base is in the first position and a second movable magnetic force part which is spaced apart from the first movable magnetic force part and located to interact with the magnetic force of the fixed magnetic force part when the movable base is in the second position.

11. The chin guard positioning assembly of claim 10, wherein the movable base includes a movable body having a movable-base seat configured to support the chin guard and to which the movable magnetic force part is fixed and the rotating shaft part is connected, and a movement connection part formed to protrude from the movable body in a direction opposite to a direction in which the chin guard is disposed, a guide part is formed in the fixed body to pass through from one surface to another surface of the fixed body so that the movement connection part is inserted into the guide part, and a lead part is formed in the movable body to pass through from one surface to another surface of the movable body so that the rotating shaft part is inserted into the lead part.

12. The chin guard positioning assembly of claim 11, wherein the guide part is formed to pass through from the one surface to the another surface of the fixed body, the guide part having a varying radius of curvature.

13. The chin guard positioning assembly of claim 12, wherein the lead part is formed to allow the rotating shaft part to be slid when a position of the movable body is moved.

14. The chin guard positioning assembly of claim 13, wherein the first movable magnetic force part is disposed to face the second movable magnetic force part with respect to the lead part.

15. The chin guard positioning assembly of claim 10, further comprising a shield moving part connected to a shield part configured to protect a face of the user to implement a movement of a position of the shield part, the shield moving part configured to be seated on the fixed body in a direction opposite to a direction in which the movable base is seated on the fixed body, wherein the shield moving part includes:

a shield connection part disposed on an upper end portion of the fixed body and connected to an end portion of the shield part;

a movement contact part disposed on a lower end portion of the fixed body; and a movement extension part configured to connect the shield connection part and the movement contact part to each other, the movement extension part including two end portions, and the shield connection part is formed to extend from one side surface of one end portion of the movement extension part in one direction, and the movement contact part is formed to extend from one side surface of the other end portion of the movement extension part in one direction.

16. The chin guard positioning assembly of claim 15, wherein the rotating shaft part includes a shaft part having two end portions, the shaft part being connected to the movable base part and rotatably connected to the fixed body and a protrusion formed to protrude from the shaft part in one direction, one end portion of the shaft part is connected to the movable base, and the protrusion is formed to protrude from the other end portion of the shaft part.

17. The chin guard positioning assembly of claim 16, wherein a position of the shield moving part is configured to be moved to allow the shield part to protect the face of the user when the shield moving part is in a front position and to allow the shield part to not protect the face of the user when the shield moving part is in a rear position, and when the shield moving part is in the front position, the movement extension part is disposed at a position which is in conflict with a movement path of the protrusion while the movable base is rotated.

18. A helmet comprising:

a helmet body providing a space configured to receive a head of a user;

a chin guard configured to be moved from a protective position, wherein a user's chin is protected, to an open position, wherein the user's chin is not protected, or moved from the open position to the protective position; and a chin guard positioning assembly connecting the helmet body and the chin guard to each other, wherein the chin guard positioning assembly includes:

a movable base connected to the chin guard and configured to move together with the chin guard when the chin guard is moved;

a fixed base connected to the helmet body, and connected to the movable base, the movable base being rotatably connected to the fixed base;

a fixed magnetic force part fixed to the fixed base; and a movable magnetic force part fixed to the movable base, the movable magnetic force fixing the movable base at a first movable-base position and at a second movable-base position by magnetically interacting with the fixed magnetic force part;

wherein the movable magnetic force part includes a first movable magnetic force part which magnetically interacts with the fixed magnetic force part when the movable base is in the first movable-base position and a second movable magnetic force part which is spaced apart from the first movable magnetic force part, the second movable magnetic force part magnetically interacting with the fixed magnetic force part when the movable base is in the second movable-base position, wherein the first movable magnetic force part and the second movable magnetic force part interact with the fixed magnetic force part.

* * * * *